US010407142B2

(12) United States Patent
Jablonkski

(10) Patent No.: US 10,407,142 B2
(45) **Date of Patent: *Sep. 10, 2019**

(54) CONTINUOUS WEAVE QUICK ADJUST HARNESS BACKPLATE SYSTEM

(71) Applicant: HALCYON MANUFACTURING, INC., High Springs, FL (US)

(72) Inventor: Jarrod Jablonkski, High Springs, FL (US)

(73) Assignee: HALCYON MANUFACTURING, INC., High Springs, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/939,056

(22) Filed: Jul. 10, 2013

(65) Prior Publication Data

US 2014/0030027 A1 Jan. 30, 2014

Related U.S. Application Data

(63) Continuation of application No. 13/788,082, filed on Mar. 7, 2013, now abandoned, which is a continuation of application No. 12/794,714, filed on Jun. 4, 2010, now Pat. No. 8,398,337.

(60) Provisional application No. 61/184,625, filed on Jun. 5, 2009.

(51) Int. Cl.

| | |
|---|---|
| ***B63C 11/02*** | (2006.01) |
| ***A45F 3/10*** | (2006.01) |
| ***A45F 3/14*** | (2006.01) |

(52) U.S. Cl.

CPC ..... *B63C 11/02* (2013.01); *A45F 3/10* (2013.01); *A45F 3/14* (2013.01); *A45F 2003/146* (2013.01); *B63C 2011/026* (2013.01); *Y10T 24/4047* (2015.01)

(58) Field of Classification Search

CPC ..... A45F 3/10; A45F 3/14; A45F 2003/146; B63C 11/02; B63C 2011/026; Y10T 24/4047

See application file for complete search history.

(56) References Cited

U.S. PATENT DOCUMENTS

| | | | | |
|---|---|---|---|---|
| 3,191,828 | A * | 6/1965 | Senne | 224/604 |
| 3,957,183 | A * | 5/1976 | Gadberry | 224/628 |
| 4,690,314 | A * | 9/1987 | Faulconer et al. | 224/628 |
| 5,494,377 | A * | 2/1996 | Garofalo | 405/186 |
| 5,607,258 | A * | 3/1997 | Eungard | 405/186 |
| 6,477,709 | B1 * | 11/2002 | Kawana | 2/2.15 |
| D468,792 | S * | 1/2003 | Jacoway et al. | D21/804 |
| 6,503,114 | B2 * | 1/2003 | Kawashima et al. | 441/116 |
| 6,749,370 | B1 * | 6/2004 | Urabe et al. | 405/186 |
| 6,857,820 | B2 * | 2/2005 | Jacoway et al. | 405/186 |
| D523,920 | S * | 6/2006 | Cresswell | D21/804 |

(Continued)

*Primary Examiner* — Robert Sandy
*Assistant Examiner* — Louis A Mercado
(74) *Attorney, Agent, or Firm* — Daniel S. Polley, P.A.

(57) ABSTRACT

A system to permit a diver to quickly adjust a one-piece continuous piece of webbing by simply pushing or pulling the webbing in the desired direction. The system includes accessory plate which is fixed to an existing diving backplate, which allows the webbing to slide on through the attached accessories without affecting the location of the accessories with respect to the diver's body. An improved adjustable crotch strap is also secured to the backplate. An ergonomic backplate frame is also disclosed.

16 Claims, 23 Drawing Sheets

(56) References Cited

U.S. PATENT DOCUMENTS

| | | | | |
|---|---|---|---|---|
| 7,344,116 | B2 * | 3/2008 | Ficarra et al. | 248/311.2 |
| D585,514 | S * | 1/2009 | Cresswell | D21/804 |
| 8,006,877 | B2 * | 8/2011 | Lowry et al. | 224/633 |
| 2004/0082238 | A1 * | 4/2004 | Jacoway et al. | 441/136 |

* cited by examiner

216
Double layer webbing with Plastic reinforcement sewn between layers.
210
Gromet to attach to Back Plate
212
214
Halcyon Canister Light attachment for Cinch System
2 pieces webbing sewn and bound to form belt loop. Buckle sewn to top piece.

250
230
Buckle attachment retains light canister to harness while allowing harness to move freely for adjustment.

CONTINUOUS WEAVE QUICK ADJUST HARNESS BACKPLATE SYSTEM

This application is a continuation of U.S. application Ser. No. 13/788,082, filed Mar. 7, 2013, now abandoned, which is a continuation of U.S. application Ser. No. 12/794,714, filed Jun. 4, 2010, now U.S. Pat. No. 8,398,337, which application claims the benefit of and priority to U.S. Application Ser. No. 61/184,625, filed Jun. 5, 2009, all applications are incorporated by reference in their entirety.

1. BACKGROUND OF THE INVENTION

The sport of Self Contained Underwater Breathing Apparatus ("SCUBA") requires that a diver carry a portable supply of air from which to breathe. Early divers found it was most convenient to carry this tank on their back, attaching it with as harness that could be tightened around the diver's body. Over time the sport became more popular and various mounting systems were developed. These systems typically share several common features. They provide for a tank which is attached to a lift device (Buoyancy Compensator) and then attached to the diver's body. Historically the most common system was to attach the tank to a rigid plate known as a backplate. This backplate was adjusted by the diver as a means to hold the tank steady. Over time this hard plate was integrated into a portion of the lift device and the system was designed to fit the diver like a jacket. This "jacket style" buoyancy compensator was built to match a variety of sizes i.e. small, medium, large; in man cases they also provided some measure of adjustability.

Adjustability of various diving systems has been an issue since the advent of SCUBA. This is because individuals of various sizes must personalize the SCUBA rig, in order to prevent the tank from shifting. In the past, as well as today, various products allow the diver to move the webbing to tighten or loosen the fit of the SCUBA system. Ease of adjustment was quickly seen as an important feature as was ease of removability. Divers wanted systems they could easily fit to their person but also systems that allowed quick removal. This latter concern is especially relevant in emergency situations where a diver must quickly be removed, from his or her equipment. Because typical backplate designs are cumbersome to adjust and relatively slow to remove, many manufactures began using a "quick release" buckle; this is also known as a "side release buckle". This buckle allowed the diver to depress tabs and release the webbing, freeing the system. These buckles were also typically designed so that the diver might easily tighten or loosen the strap while maintaining the continuity of the webbing.

The aforementioned adjustability creates two notable problems. First, divers using a quick release buckle might suffer from an accidental release, freeing the system unintentionally. In this case it is possible tot the diver to become separated from their life support system. Secondarily, the adjustability of the webbing is accomplished by weaving a free end of the webbing through the buckle. This routing leaves a tail that hangs below the diver. This dangling strap can catch on protrusions, snagging the diver or damaging the environment.

The instant inventor has always prioritized the need to avoid both risks by promoting continuous "one piece" style webbing. Other manufactures also use one piece webbings that me not notably dissimilar to very early diving systems. However, systems that utilize a one piece design are difficult to adjust and are not quickly removed during emergencies.

The present invention is directed addressing the above and also provides many other benefits and advantages.

2. SUMMARY OF THE INVENTION

The present invention provides all the benefits relevant to quick adjust and quick release systems but without the aforementioned disadvantages, such as but not limited to unintentional or accidental release of the quick release buckle. The present invention permits the diver to quickly adjust a one-piece continuous piece of webbing by simply pushing or pulling the webbing in the desired direction. The functionality can be accomplished in several ways with the first iteration being, an accessory plate which is fixed to an existing diving backplate. This product is the core of the system allowing the webbing to slide on through a smooth passage. Other embodiments of the invention allow the webbing to slide through fixed and rotating roller bars. The same function can also be performed by looping the webbing through a smooth portion of a mold or fabricated backplate which is considered another embodiment of the invention.

The present invention permits for the rapid adjustment of the webbing. Yet, the functionality is further enhanced by additional inventive features that support accessory items to be fixed at the waist. The webbing is permitted to slide through these fixtures. Normally sliding webbing would prevent a fixed position for accessories. However, the present invention supports any needed waist mounted accessory. As a non-limiting example, a primary diving light mounted to the hip will stay in place while the webbing slides to adjust for the diver's size. Similarly, a fixed d-ring can be mounted to the diver'S hip with the webbing sliding through the fixture. These features allow any range of items to be fixed to the diver's waist while allowing full adjustability to the webbing.

Consonant with the need to adjust the diver's waist and arm webbing is the need for an adjustable crotch strap which is also achieved by the present invention. A crotch strap prevents the diver's system from sliding up and above their head. Conventional crotch straps are extremely useful though usually cumbersome to adjust and also often suffer from the same dangling entrapments problems discussed above for typical quick adjust buckles. The present invention provides a buckle that eliminates all excess webbing of the crotch strap while allowing the crotch strap to be adjusted quickly and easily. Once adjusted the buckle maintains a firm grip and even allows significant torque on the crotch strap such as incurred while being pulled by a DPV.

A unique and novel back plate frame and design is also disclosed. With the present invention, full adjustability of a backplate is also achieved to account for the size and height of various divers. Such adjustability permits divers to expand/shrink the backplate as required.

3. BRIEF DESCRIPTION OF THE DRAWINGS

Figure 1:
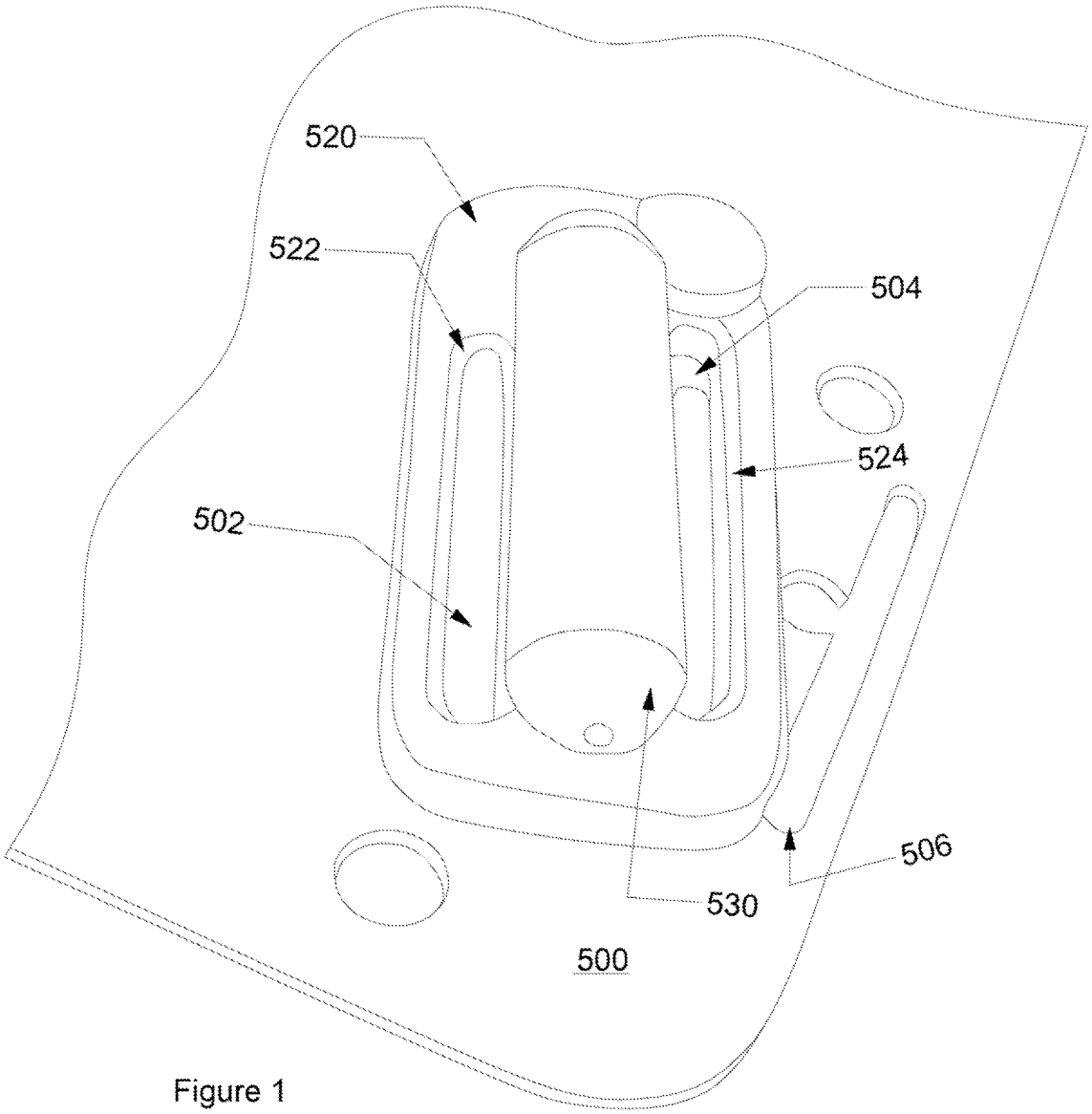
FIG. 1 is a perspective view of a lower corner of a modified backplate and having a first embodiment for a single side cinch secured thereto in accordance with the present invention.
Figure 4:
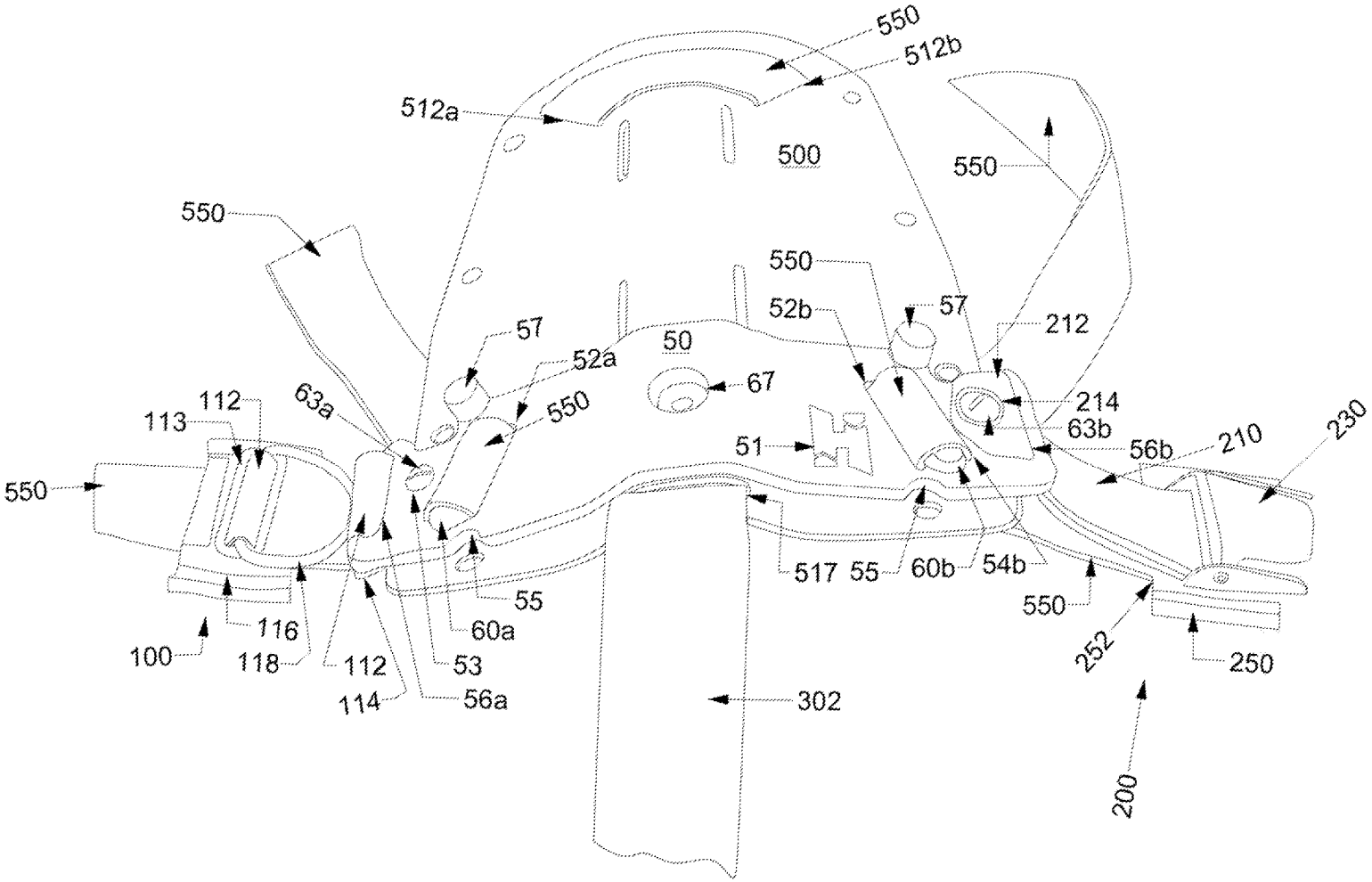
FIG. 4 is a perspective view of a full cinch adaptor or plate secured to a conventional backplate in accordance with the present invention.
Figure 5:
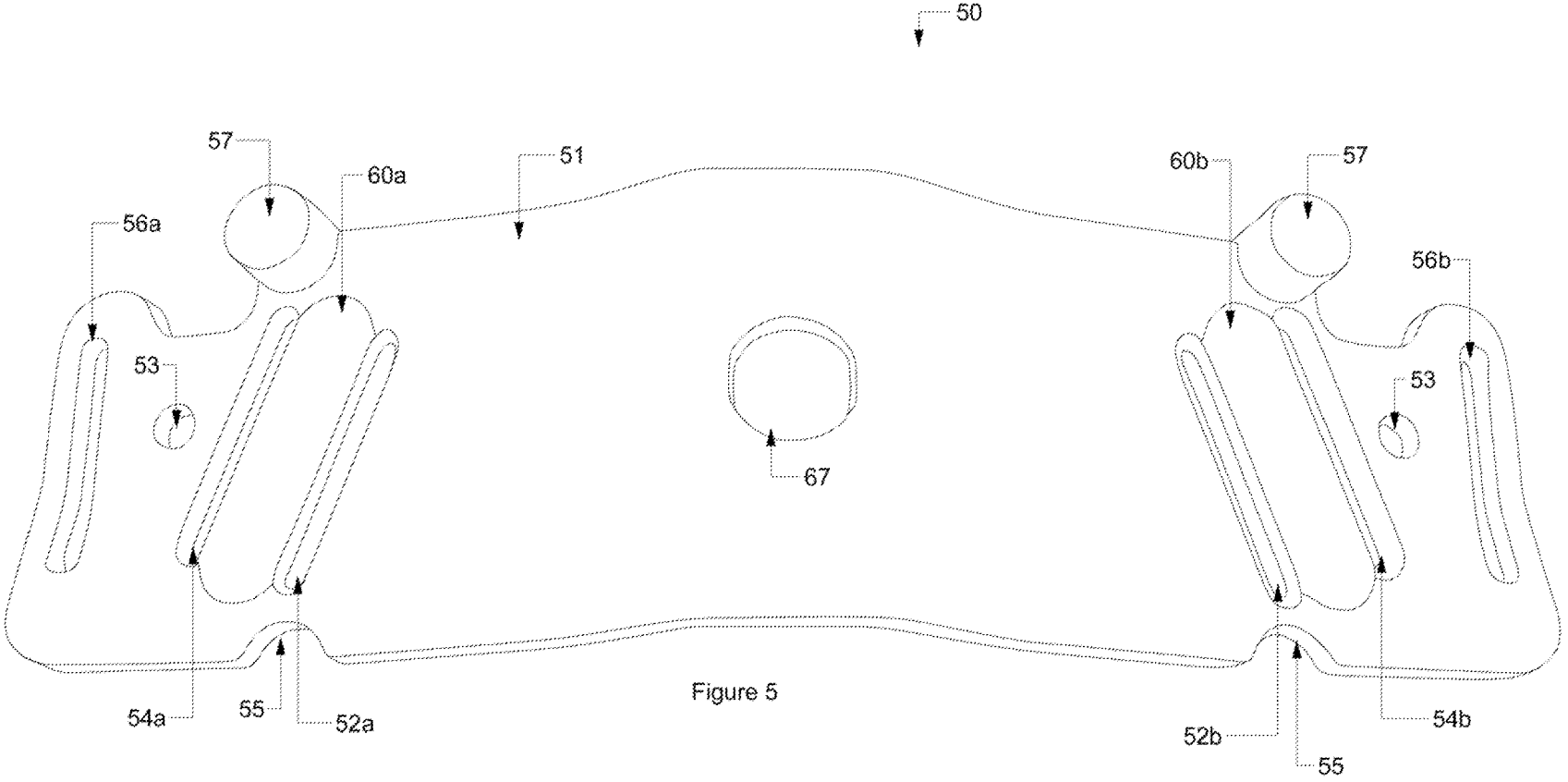
FIG. 5 is a perspective view of the full cinch adaptor of FIG. 4.
Figure 6:
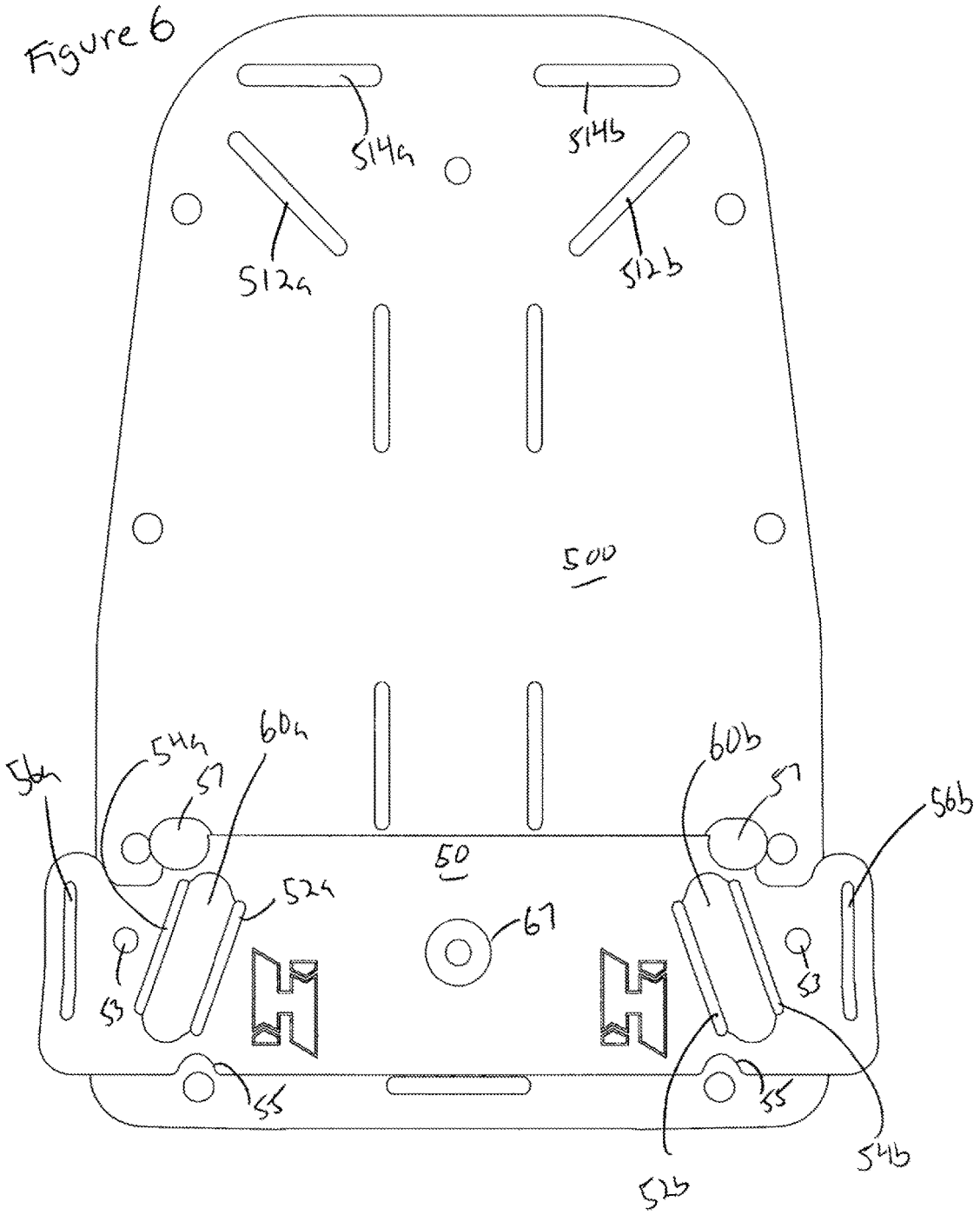
FIG. 6 is a front elevational view of the full cinch adaptor of FIG. 4 secured to a conventional backplate.
Figure 7:
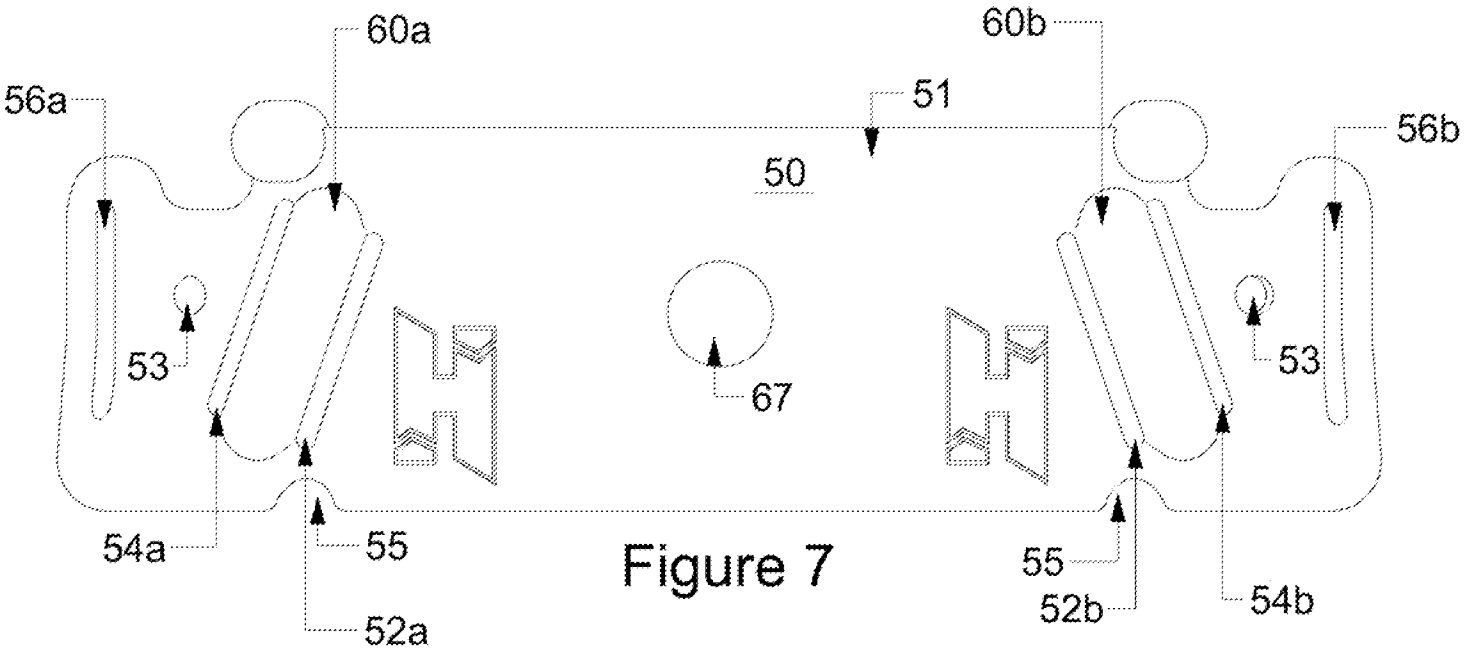
FIG. 7 is a front elevational view of the full cinch adaptor of FIG. 4.
Figure 8:
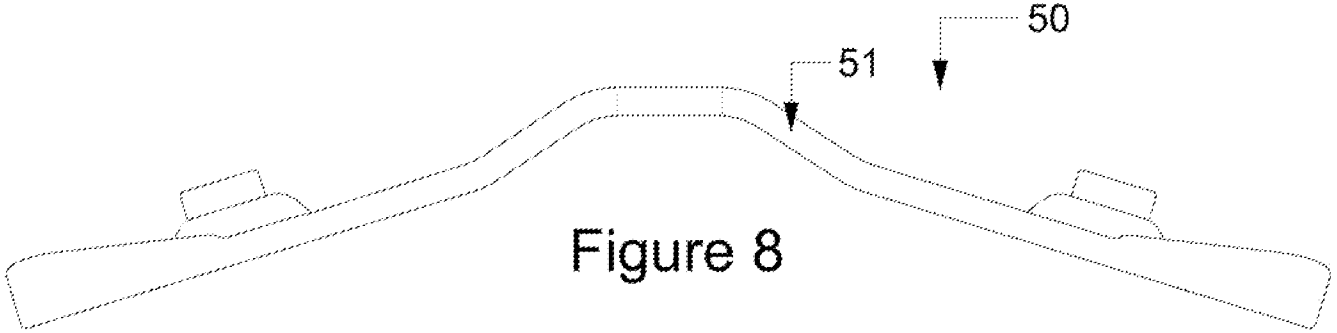
FIG. 8 is a top view of the full cinch adaptor of FIG. 4.
Figure 9:
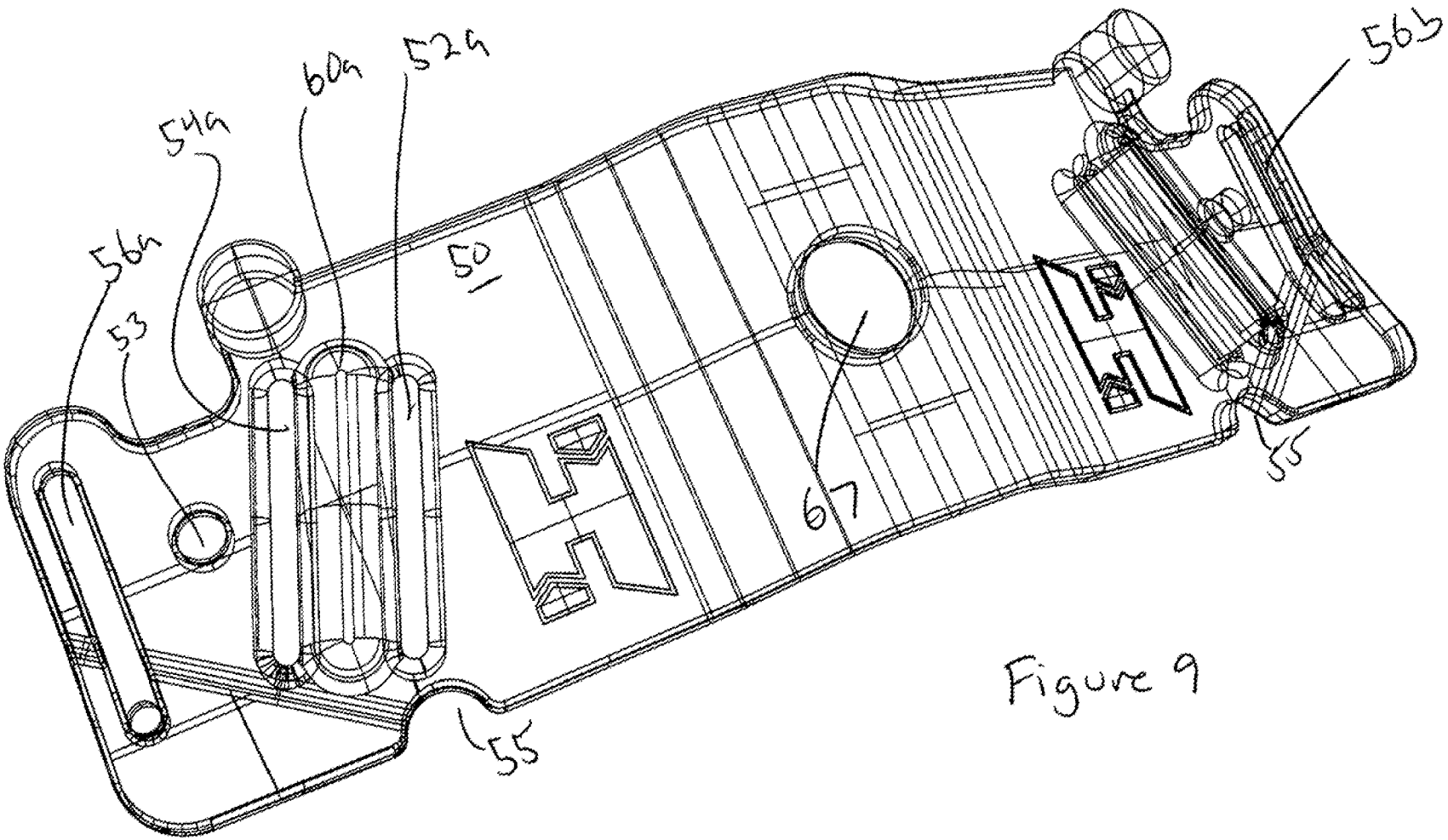
FIG. 9 is another perspective view of the full cinch adaptor of FIG. 4.
Figure 10:
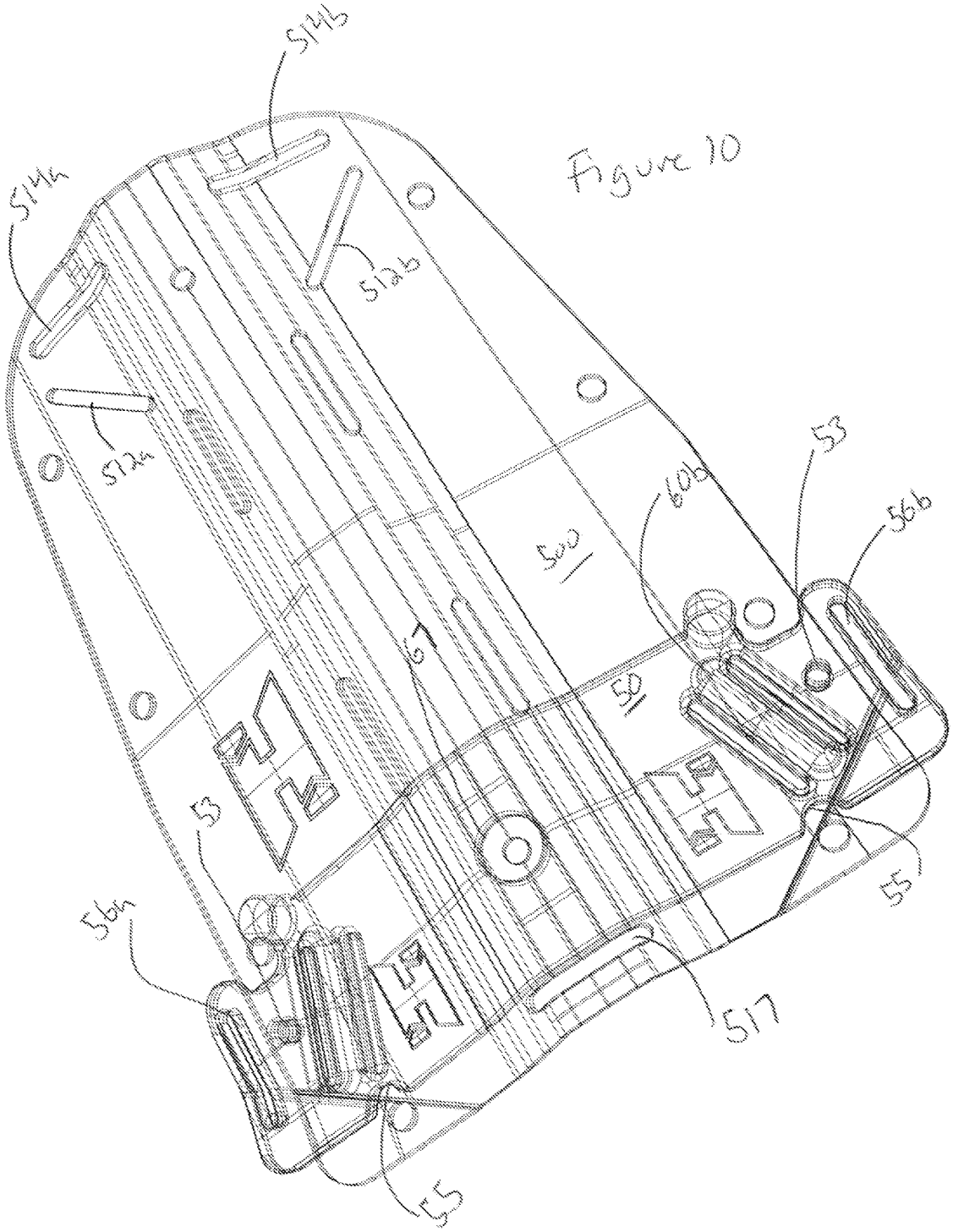
FIG. 10 is another perspective view of the full cinch adaptor of FIG. 4 secured to a conventional backplate.
Figure 11:
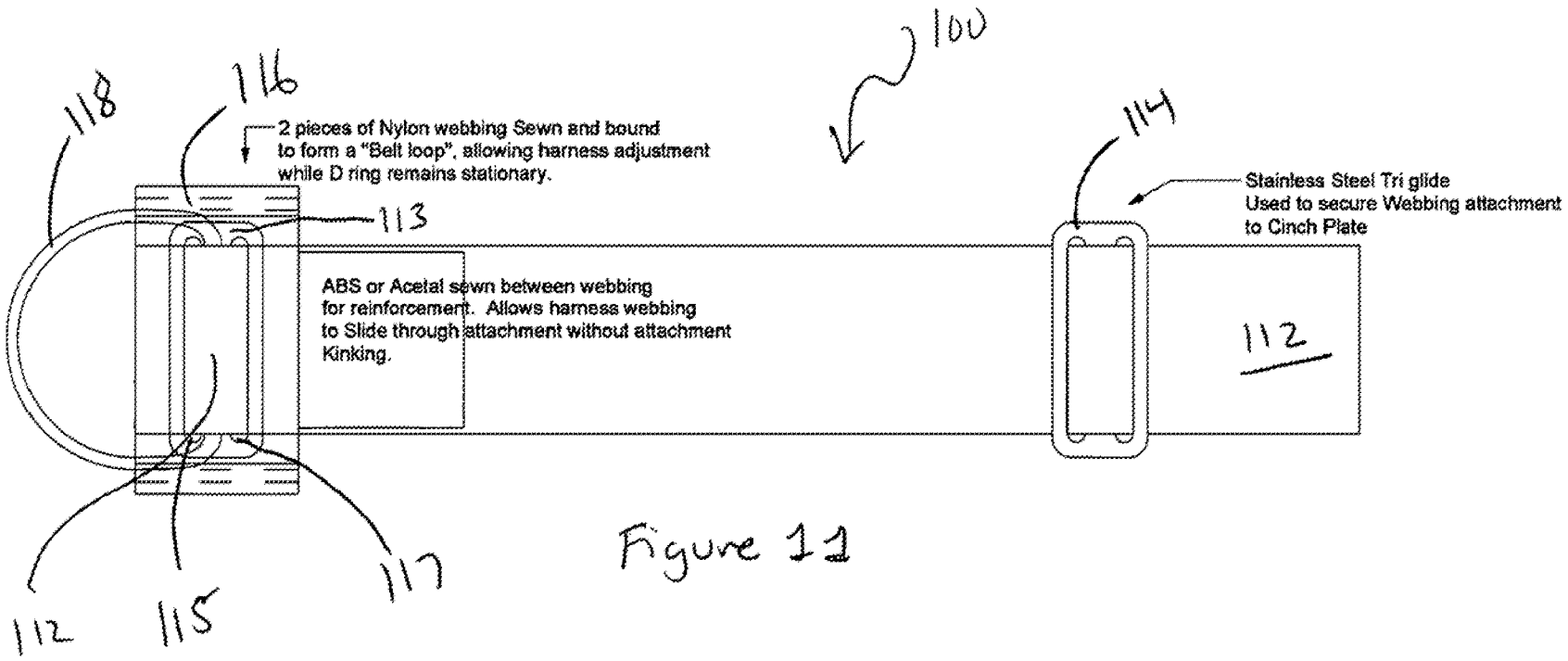
FIG. 11 is a bruit elevational view of a novel D-ring accessory that can be secured to the single side cinch or the full cinch adaptor in accordance with the present invention.
Figures 12A, 12B:
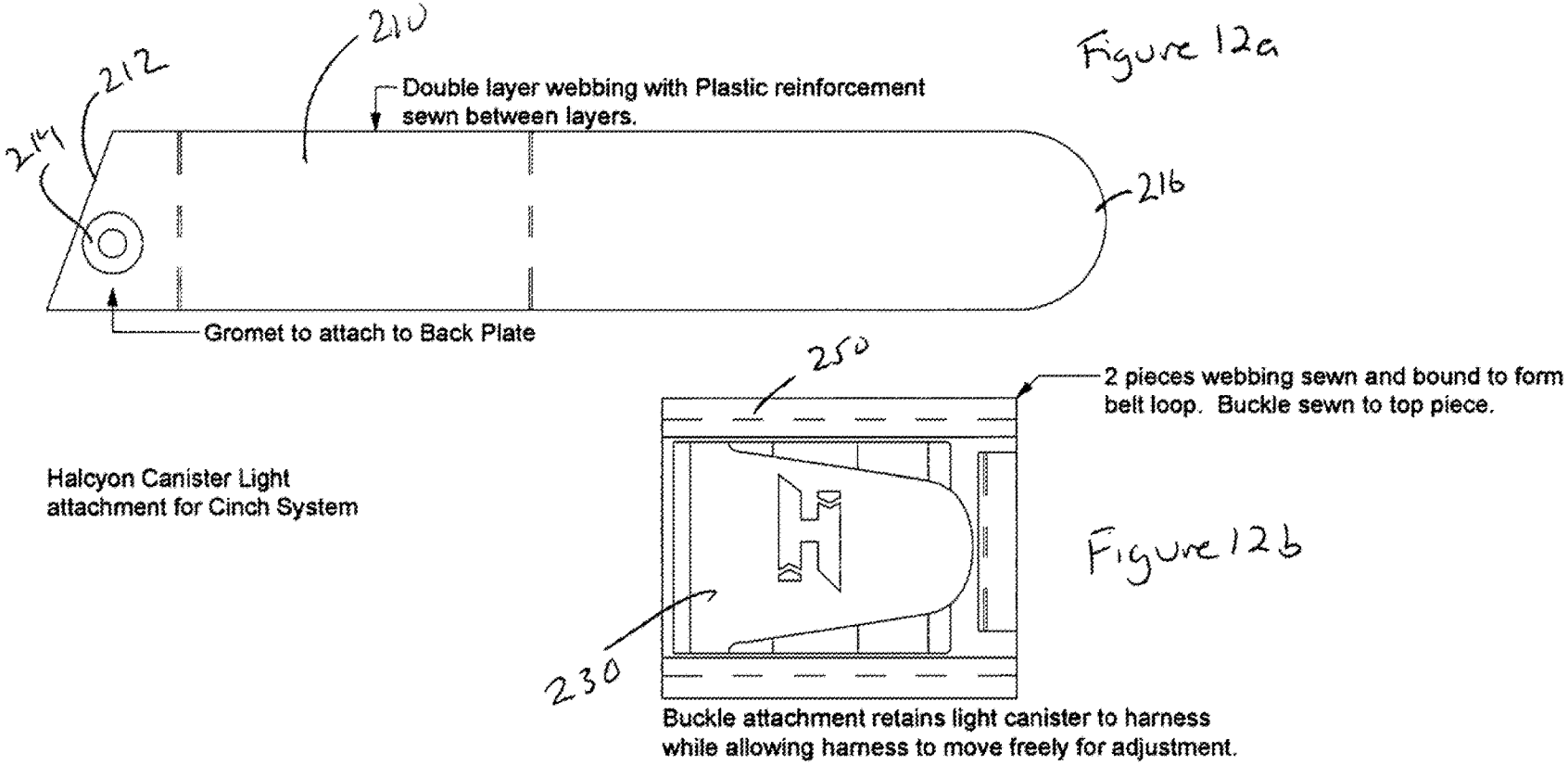
Figure 13:
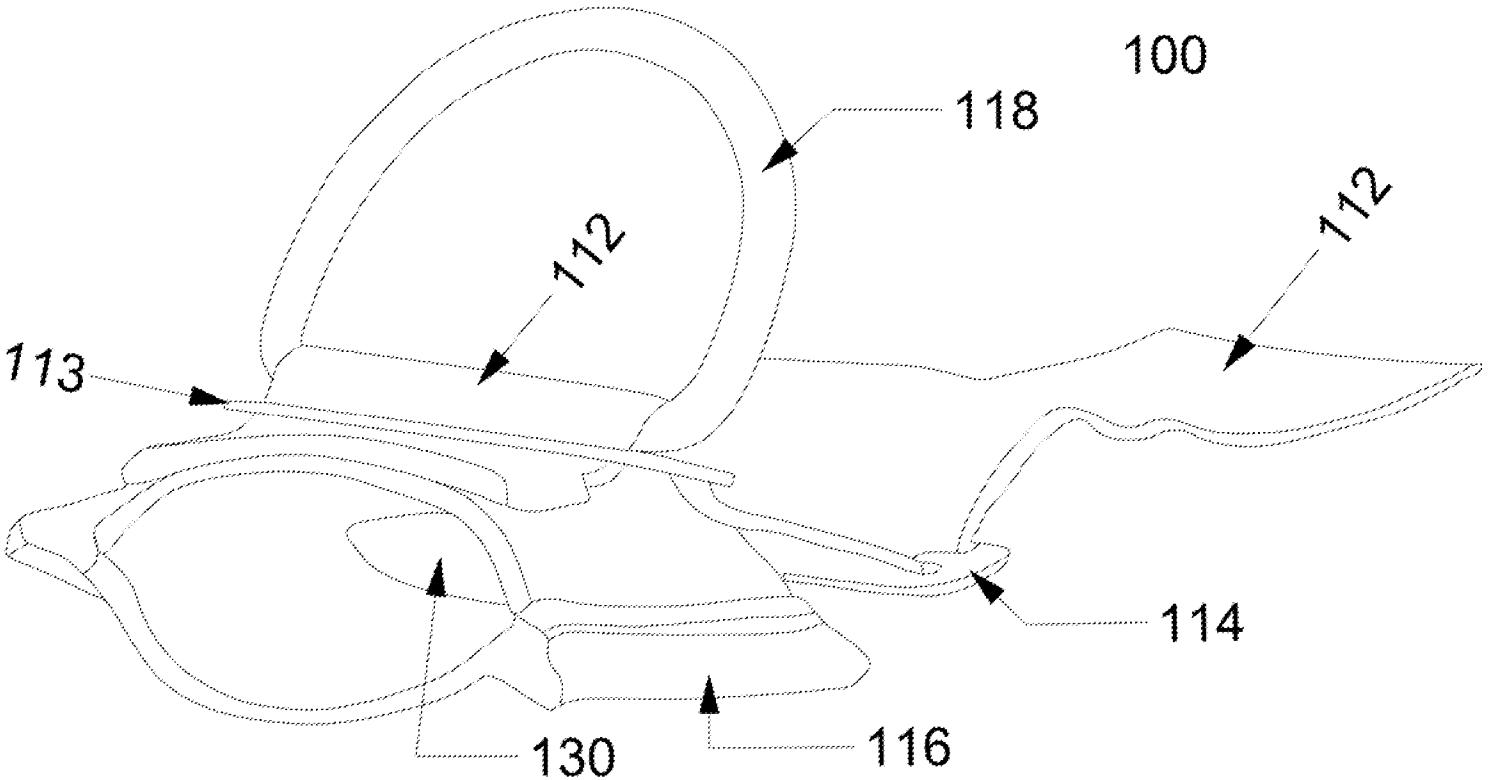
Figure 14:
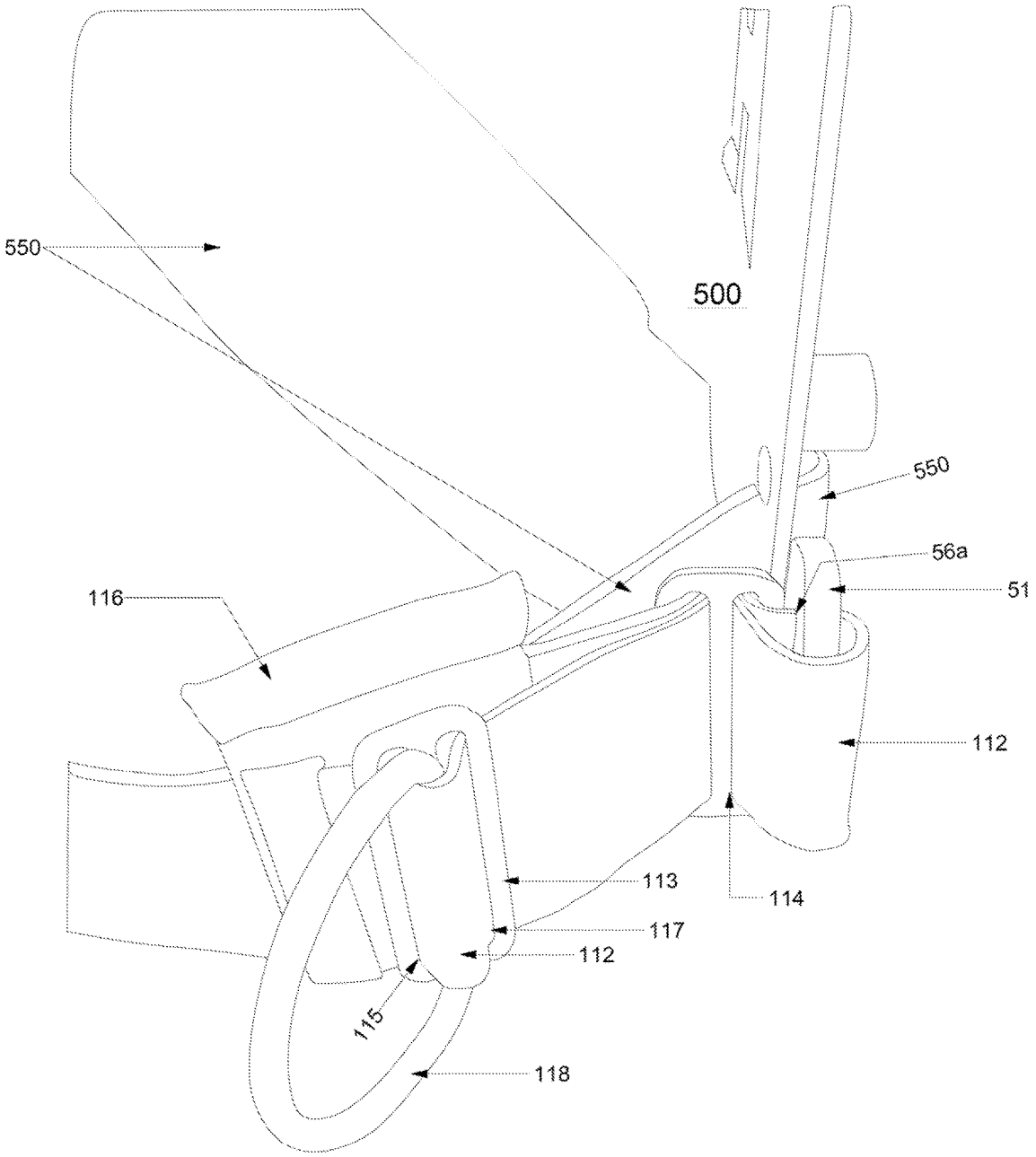
Figure 15:
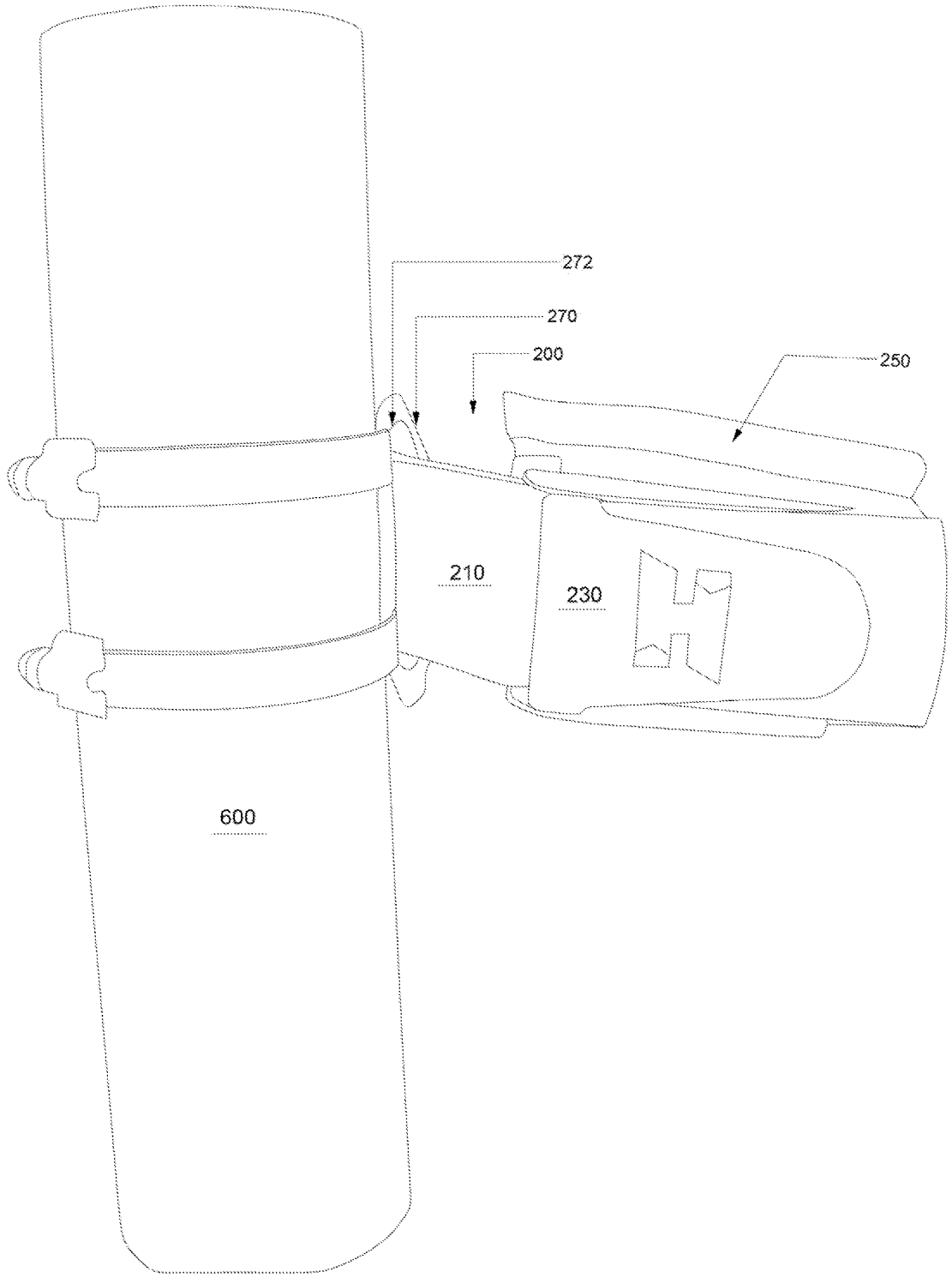
Figure 16:
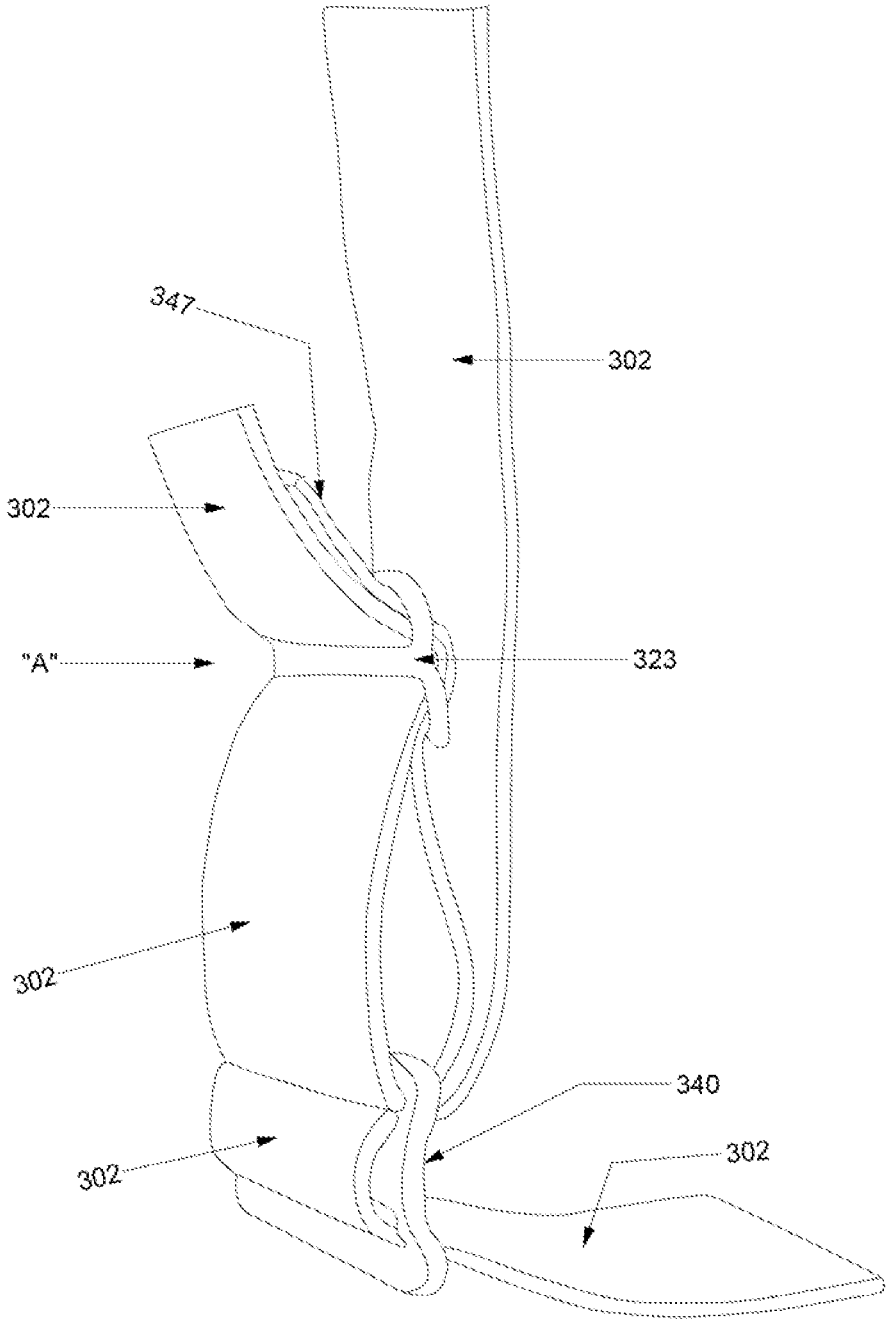
Figure 17:
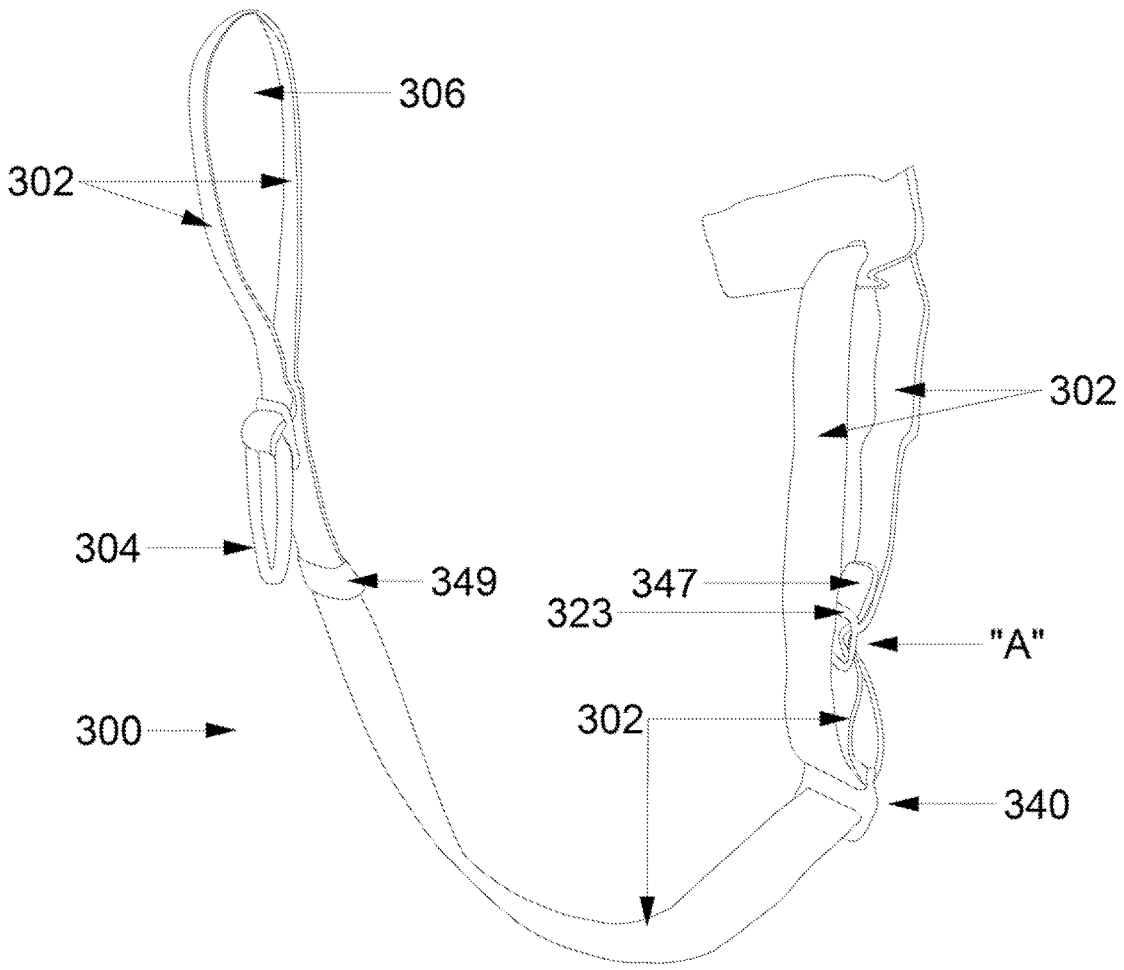
Figure 18A:
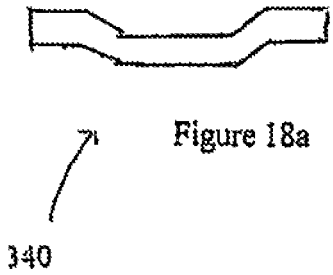
Figure 18B:
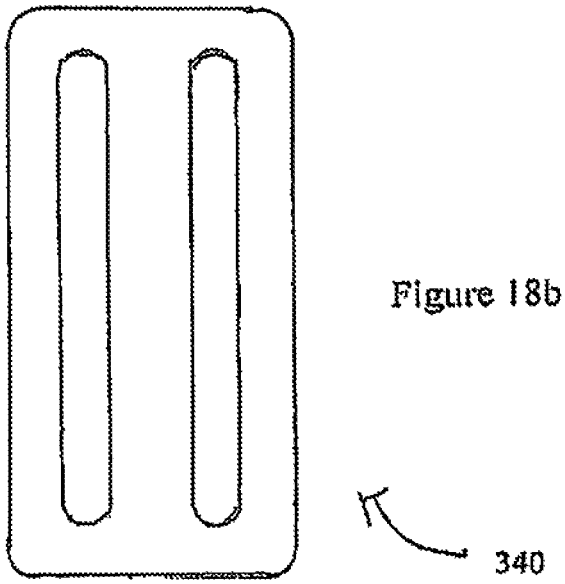
Figure 18C:
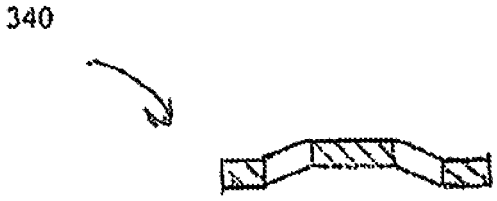
Figure 19:
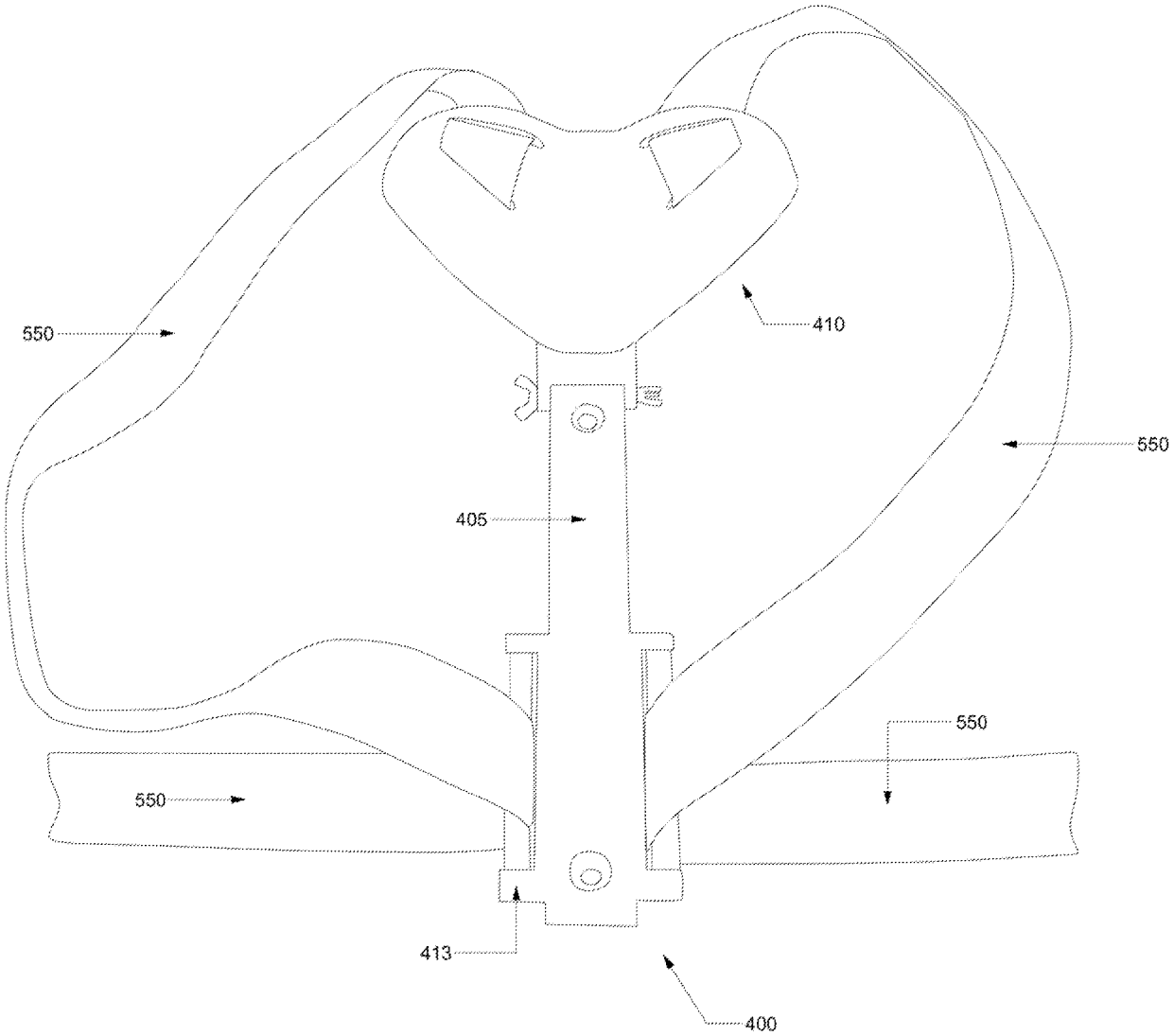
Figure 20:
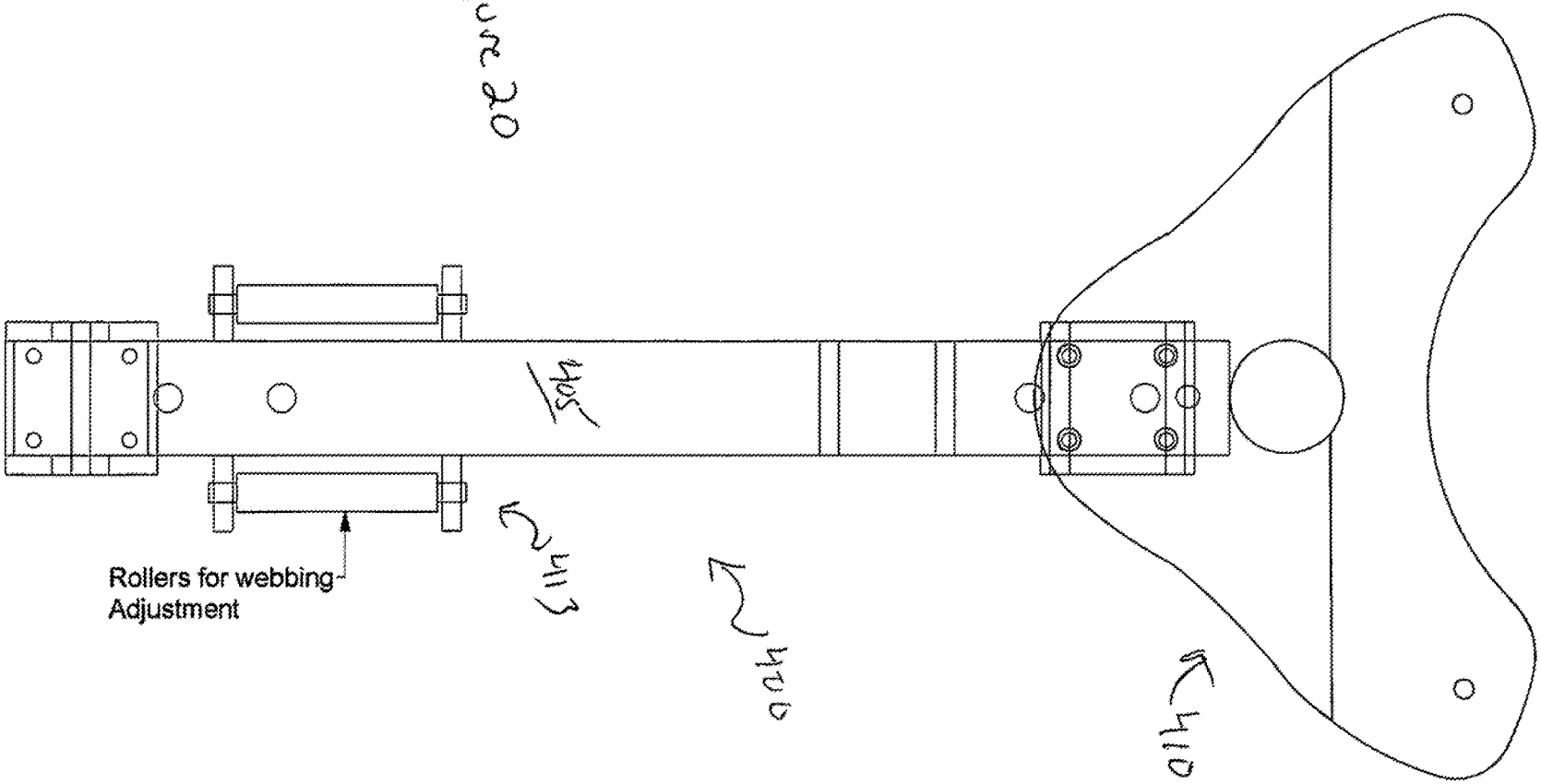
Figure 21:
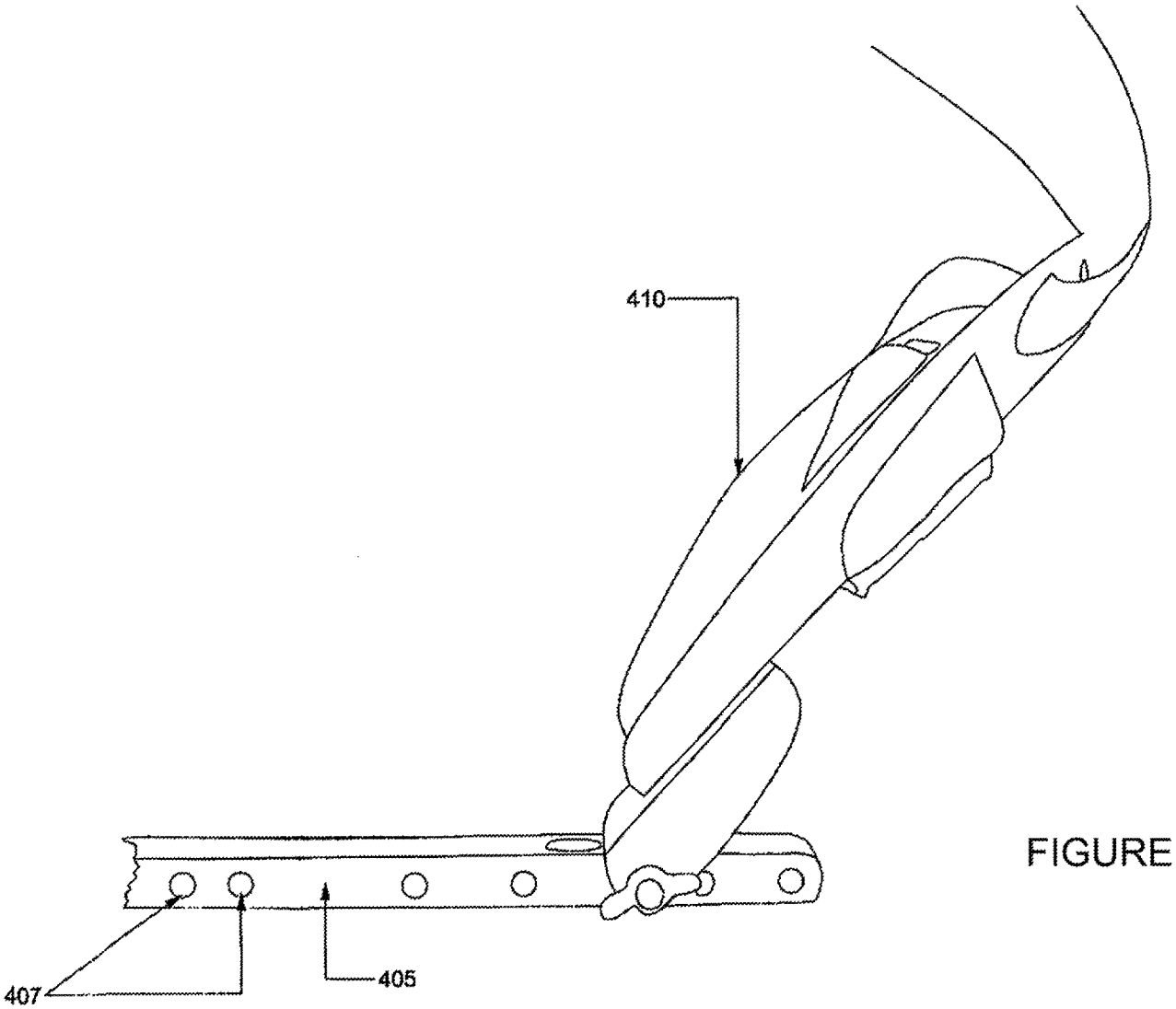
Figure 22:
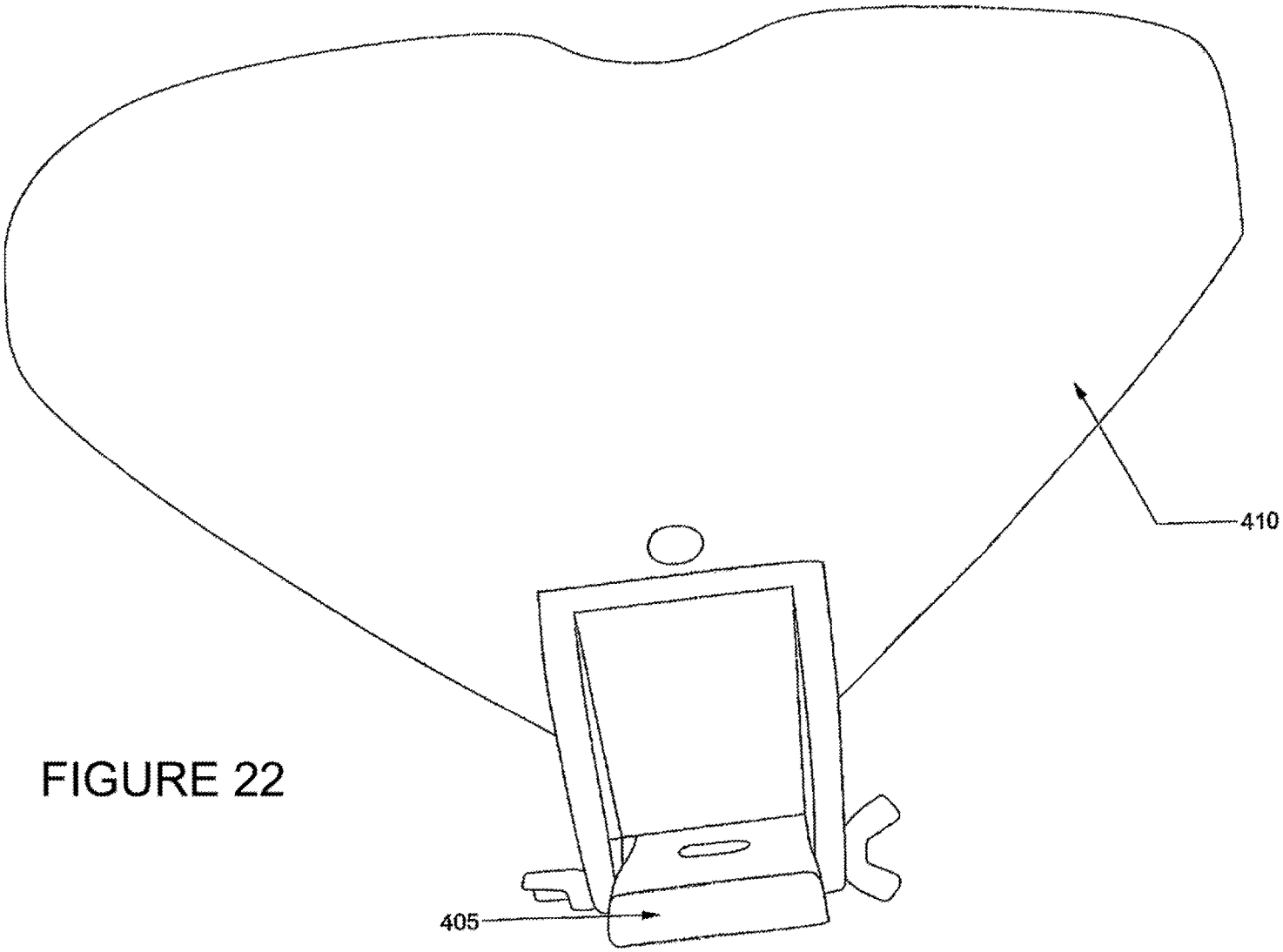
Figure 23:
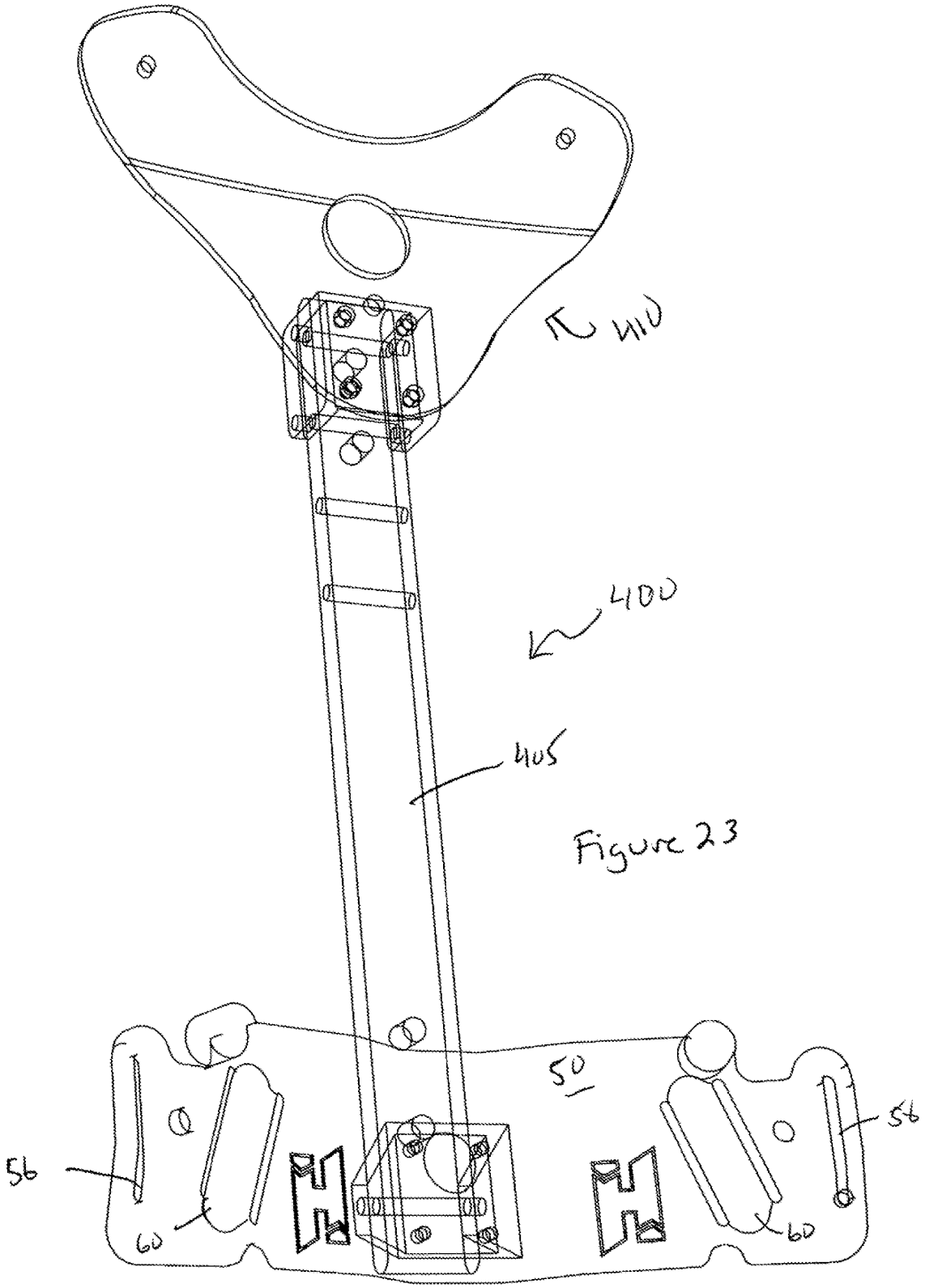
Figure 24:
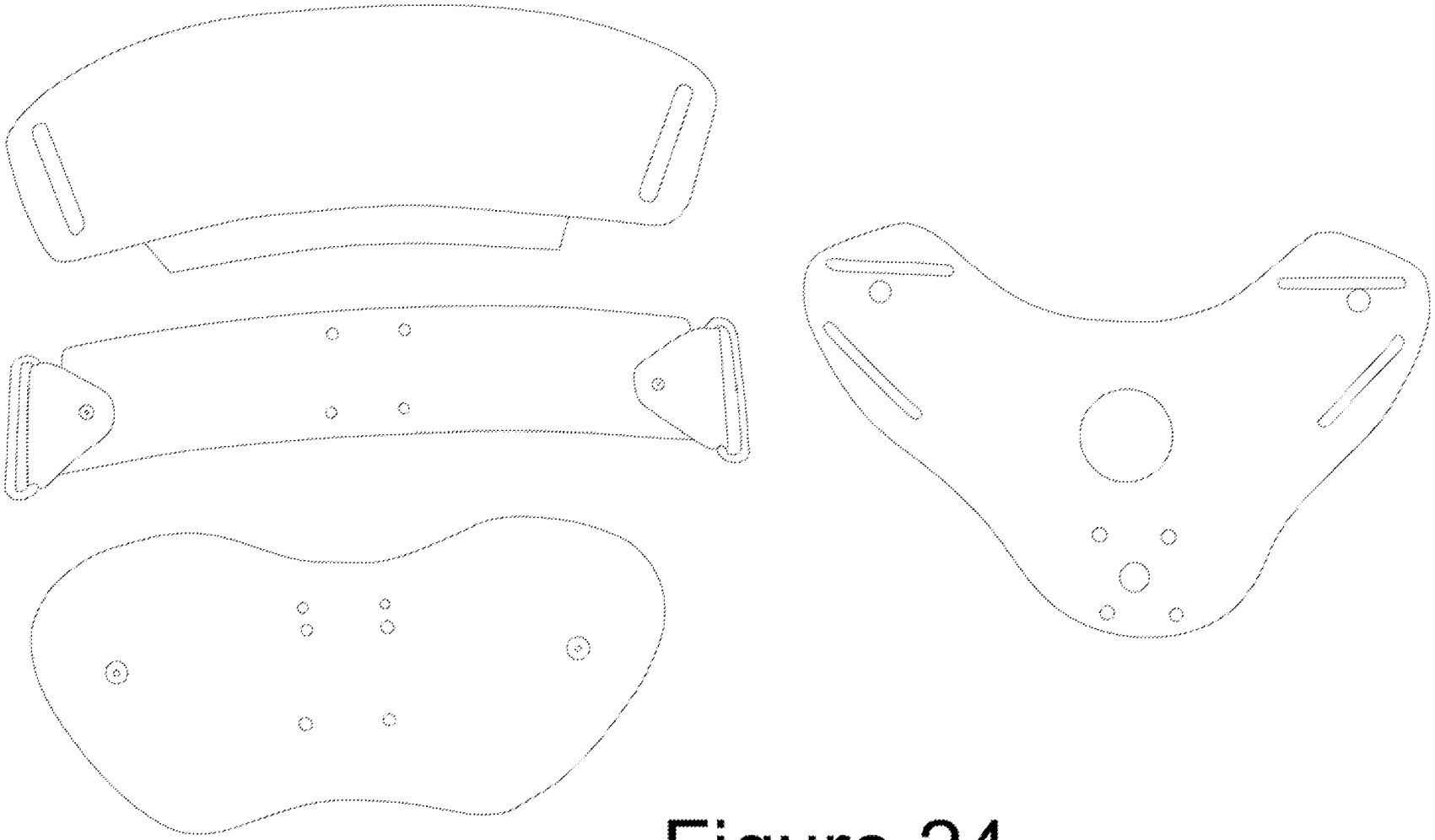

FIGS. 12*a* and 12*b* illustrate the novel canister light attachment accessory that can be secured to be single side cinch or the full cinch adaptor in accordance with the present invention;

FIG. 13 is a perspective view of the novel D-ring accessory of FIG. 11 illustrating the loop or passageway for permuting the harness webbing to be pass through and to be freely adjustable without affecting or moving the position of the D-ring accessory in relation to the diver (a similar loop or passageway is also provided with the buckle portion of the novel canister light attachment accessory of FIG. 12*b* for similar reasons and purposes);

FIG. 14 is a perspective view of the novel D-ring accessory of FIG. 1 secured to a side of the full cinch adaptor of FIG. 4 and having the harness webbing passing through the loop or passageway best illustrated in FIG. 13;

FIG. 15 is a perspective view of the novel canister light attachment accessory of FIGS. 12*a* and 12*b* secured to a side of the full cinch adaptor of FIG. 4 and having the harness webbing passing through the loop or passageway best illustrated in FIG. 13 in connection with the D-ring accessory;

FIG. 16 is a perspective view of the novel crotch strap in accordance with the present invention;

FIG. 17 is another perspective view of the novel crotch strap of FIG. 16;

FIGS. 18*a*, 18*b* and 18*c* illustrate several view of a novel tri-glide that is used as pan of the novel crotch strap of FIG. 16;

FIG. 19 is a perspective view of a novel backplate frame design and shape in accordance with the present invention;

FIG. 20 is a top view of the novel backplate frame of FIG. 19;

FIG. 21 is a partial side perspective view showing a top end of the novel backplate frame of FIG. 19;

FIG. 22 is a different partial side perspective view showing the top end of the novel backplate frame of FIG. 19;

FIG. 23 is a perspective view of the novel backplate frame of FIG. 19 having the full cinch adaptor of FIG. 4 secured at a bottom end of the frame; and FIG. 24 are perspective view showing different parts that can be used as part of the novel backplate frame.

4. DETAILED DESCRIPTION OF THE INVENTION

As seen in the various drawings several embodiments are disclosed for a continuous weave, quick adjust harness backplate system. Applicant also incorporates by reference all of the pictures files as part of the above-identified provisional application. It is noted that the provisional drawings were also labeled With shun descriptions that me also incorporated by reference.

Figure 2:
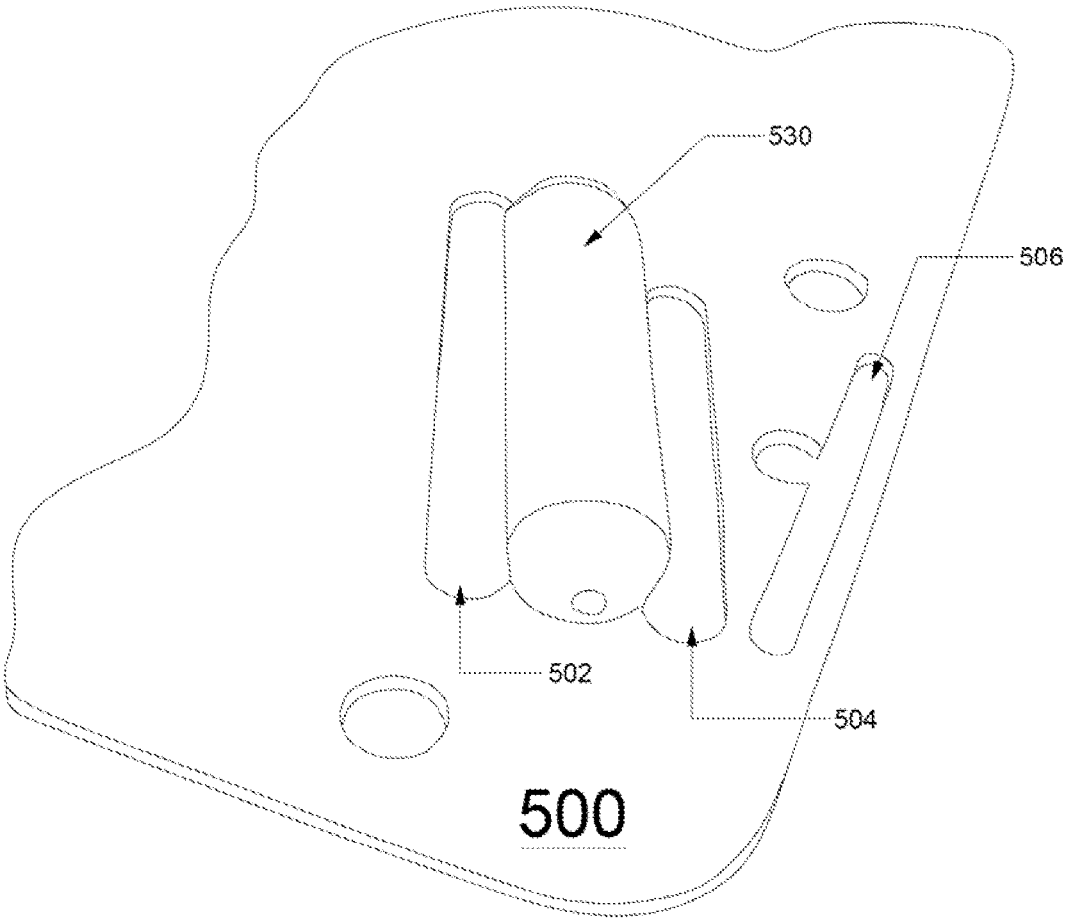
FIG. 2 is a perspective view of a lower corner of a modified backplate and having a second embodiment for a single side cinch secured thereto in accordance with the present invention.
Figure 3:
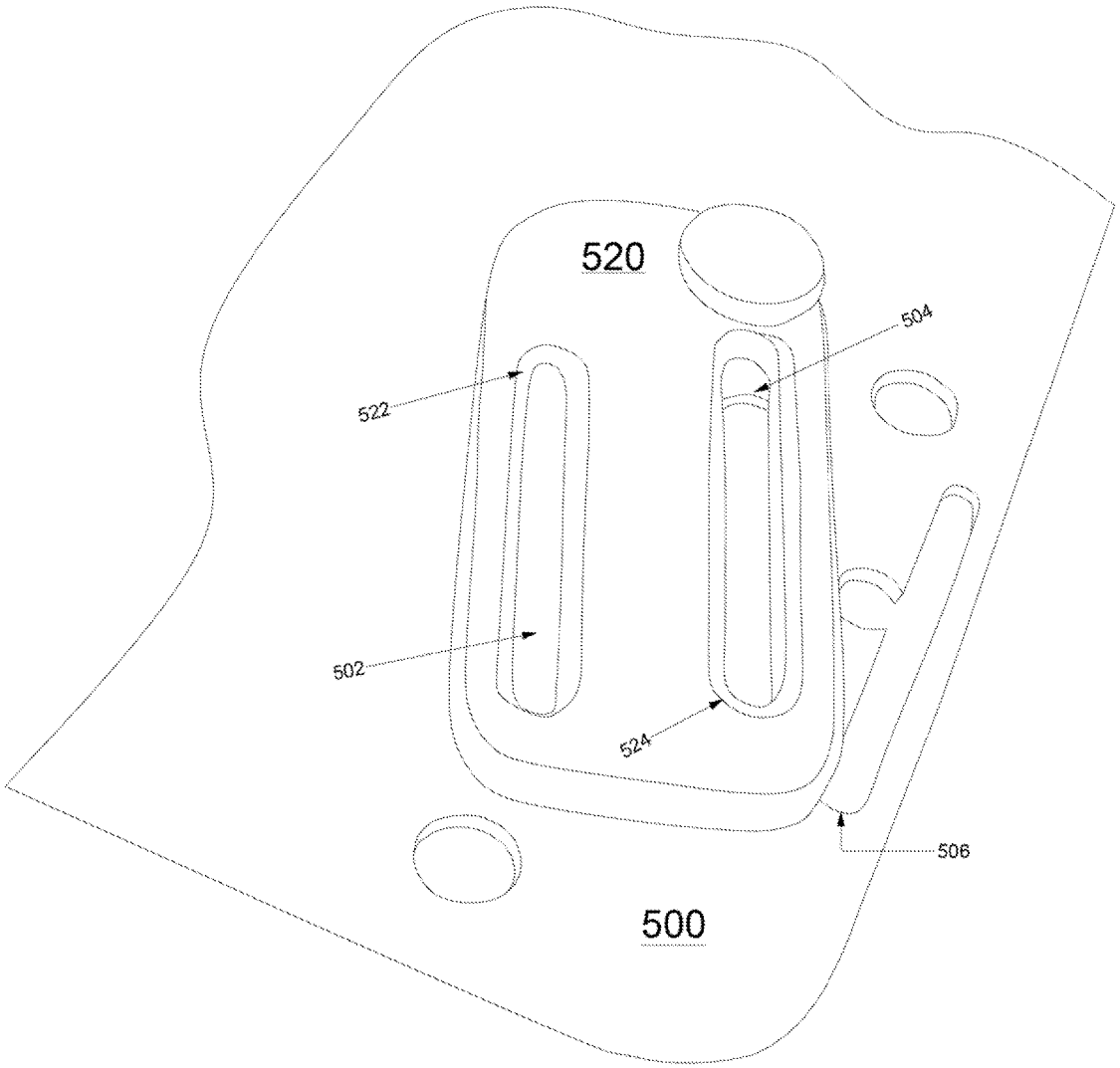
FIG. 3 is a perspective view of a lower corner of a modified backplate and having a third embodiment for a single side cinch secured thereto in accordance with the present invention.

As seen in FIGS. 1-3, three different embodiments are illustrated for a single side cinch which can be secured to an existing backplate.

In all three embodiments shown in FIGS. 1-3, a first series of modifications were made to current backplate 500 technology in order for a continuous shoulder webbing portion to easily flow through to the waist webbing portion and automatically adjust and yet still tension while the user is wearing bookplate 500. With the present invention, differences in the elongation or length of the lower set of slots 502 and 504 on an angle are provided as well as the addition of one extra slot 506 on each side of the plate to the right (i.e. outer slot). This outer slot accommodates the flow through attachment devices of the present invention (i.e. D-ring assembly, Light holder assembly, weight pocket, etc.) that are described in detail below and which provide additional benefits and advantages to the diver user.

The three embodiments shown in FIGS. 1-3 will be referred to as single side cinch adaptors as they are secured to only one side of bookplate 500 and need separate single side cinch adaptors for each side of bookplate 500 and preferably additional slot 506 is also provided on each side of backplate 500.

As seen in FIG. 3, in one embodiment, the single cinch embodiment consist of an enhancement device 520 having slots 522 and 524, Enhancement device 520 can be constructed from plastic, though such is not considered limiting and other relatively rigid materials can be used and are considered within the scope of the invention and is secured to the back side of backplate 500 by conventional means, such that slot 522 aligns with bookplate slot 502 and slot 524 aligns with backplate slot 504. In this embodiment of the present invention, enhancement device 520 permits the waist webbing portion of the continuous webbing to slide through the aligned slots easier for enhanced and easier adjustment of the webbing. As a variation, FIG. 1 shows a roller, rod or other round or smooth member 530, which can also be a raised portion of enhancement device 520 that is secured or disposed on the top surface of enhancement 520 between slots 522 and 524.

FIG. 2 illustrates a variation where there is no enhancement device 520 but rod or smooth member 530 is secured directly to bookplate 500 between slots 502 and 504. One of the two slots can be elongated in length, which preferably is slot 502, the closest slot to the center of the plate. This extra elongation of slot 502, which can be used with all three variations or embodiments, enhances the flow through of the webbing once the diver's waist belt is open. The extra elongation allows the webbing to flow more easily through and around the slots which aids in the adjustability of the webbing by the user while he or she is wearing bookplate 500.

Another aspect of the present invention shown in FIGS. 1 through 3, as well as in the full cinch adaptor plate discussed below, is the accessory component that makes adjustability of the webbing feasible without having to remove or readjust the dive canister light or other attached accessory. With current technology the dive light is mounted in a fixed position with a conventional weight belt buckle to the waist harness strap, which completely circumvents any adjustability of the shoulder harness. The present invention allows that waist webbing and the shoulder webbing to flow directly through a passageway defined by the accessory attachment member and without having to remove the light canister, as the accessory attachment member is not permanently affixed to the webbing. Thus, the movement of the webbing by the user during adjustment does not affect the position of the light canister or other attached accessory. This feature will be discussed in more detail below. With the embodiments shown in FIGS. 1-3, the light holder and other accessories are fixed to backplate 500 in conjunction with slot 506 (and not to the webbing which passes through a belt loop like member or other passageway associated with the light holder and other accessories).

In all embodiments or variations adjustability of the webbing is improved and all embodiments and variations can be used with existing, old backplates in the field for such purposes. With current backplate technology the webbing is threaded through one hole or slot 502 and then quickly back out through the adjacent slot 504 (with both slots basically having the same length) and the tight bend radius between these two slots causes the webbing to stay locked. From a position, of the wearer and especially considering his or her hand position in a shoulder back extended position, it is not feasible for the user to easily adjust and open up the webbing holes for exit or entry into the harness with current backplate technology. However, with the present invention, the enhancement devices shown in FIGS. 1-3, as well as the full cinch adaptor plate described below that are secured to backplate 500 at the lower back portion adjacent the slots helps to greatly reduce the friction of the webbing between the two slots and permits for more of an even flow for the webbing. Thus with the present invention, older backplates 500 in the field can be retro-fitted to include, the enhancement device. If not already provided, certain older backplates may also require that assembly holes be created for attaching the enhancement device in the plate and/or that one or more slots be elongated. Additionally accessory slot 506 can also be created in existing backplate 500. When retrofitting an existing with the full cinch adaptor plate described below, the additional accessory slot 506 is does not have to added to backplate 500, as the full cinch adaptor plate also provides accessory slots on each side of its body member. It is also possible to extend enhancement devices 520 such that the extend beyond the edge of backplate 500, which would permit an accessory slot to be created in enhancement device 520 and eliminate having to create slot 506 in backplate for securing the accessories.

As best seen in FIGS. 4 through 10 a rigid full cinch plate or adaptor 50 can be provided and affixed to hack plate 500. The word "full" is chosen to reflect that it covers or takes care of both sides of backplate 500, Preferably, cinch plate 50 is shaped to conform to the shape of backplate 500 to which it will be affixed to, though such is not considered limiting. Full cinch 50 allows continuous harness webbing 550 to adjust easily while in or out of the water. The quick adjust function of webbing 550 occurs while leaving waist mounted weight, d-ring and/or primary light, or other accessories, unaffected. This is made possible by the use of the below described novel attachment configurations for the light assembly (FIGS. 12*a* and 12*b*), D-ring assembly (FIGS. 11 and 13) and/or weight pocket attachment assembly, such as, but not limited to, an active control ballast weight pocket. Additionally, a unique quick adjust buckle can be provided to allow the diver to rapidly customize the fit of their crotch strap which will also be discussed in more detail below. It should also be recognized that though it is preferred to use a continuous webbing such as, but not limited to, webbing 550, other non-continuous webbing configurations can also be used with the various cinch embodiments and benefit therefrom.

Full cinch adaptor plate 50 can be a high-quality injection molded assembly that attaches to your back plate, though such is not considered limiting and can be constructed from a variety of materials that creates a hard or rigid plate body member 51. Cinch plate 50 can be provided with an accessory attachment slot 56*a* and 56*b* on each end or side. At least one and preferably a plurality of holes, such as, but not limited to, two holes 53 can be provided that affix cinch plate 50 to backplate 500. A first series of slanted or angled slots 52*a* and 54*a* are provided on a left side of body member 51 and a second series of slanted or angled slots 52*b* and 54*b* are provided on a right side of body member 51. Slots 52*a*, 54*a* and 52*b*, 54*b* are aligned with harness backplate slots 502, 504 (similar to enhancement device 520) when cinch plate 50 is properly secured to hack plate 500. A riser or other hump like portions 60*a* and 60*b* are provided between slots 52*a*, 54*a* and 52*b*, 54*b*, respectively, for similar purposes as rod 530 of enhancement device 520. Riser 60*a* and 60*b* create slick or smooth surfaces that allow harness webbing 550 to slide freely when needed, but to remain secure while the diver is standing up with tanks on the diver's back.

Full cinch adaptor 50 may be used with a single or double tank. When in use with doubles, the lower part of the backplate can use molded spacers to keep the harness webbing from being pinched by the tanks, which helps to ensure that the webbing can slide freely. In most cases the lower bolt of the diver's double tanks will be of sufficient length to allow this slight offset. However, by using a bolt extender the diver is allowed to extend a short lower bolt where necessary. The bolt extender can be threaded directly to the lower bolt of a double tank configuration and in one non-limiting embodiment can use an inset Allen key fitting so it can be easily tightened in place.

When attaching the cinch adjustment plate 50 to an existing backplate 500 the old webbing should be replaced as it most likely will contain numerous wear spots and indents from d-rings and belt buckles, which could interfere with the smooth adjustment of the webbing with the cinch plate.

To install cinch plate 50 to an existing backplate 500 (having its old webbing and hardware secured thereto) the buckle, d-rings and triglides are removed from the waist strap. The waist strap is preferably unweaved from the lower slots 502 and 504 on the back plate and the tri glides are removed from behind the plate. The chest d-rings are also removed and finally the old webbing from the top backplate slots is removed.

With everything removed, the cinch plate assembly 50 is ready for attachment to backplate 500. Various attachment/fastening devices or hardware can be used for the attachment and all are considered within the scope of the invention. The attachment component describe herein are only by way of example and are not considered limiting. Two bolts 63*a* and 63*b* (relatively long) can be used for attachment purposes. Bolt 63*b* on the right side (as backplate 500 is worn by the diver) preferably secures cinch plate 50 and the light holder assembly (described in more detail below). If a hip mounted primary light is intended to be used by the diver the light bolder assembly can also be installed at this time. Preferably the attachment hardware is provided with pre-applied loctite to ensure the connections remain secure. The preferred bolts should be able to tolerate several removal and replacement sessions before the loctite becomes ineffective.

After cinch plate 50 is installed to backplate 500 the desired accessory(ies) can be attached. Accessories can include the Halcyon weight pockets, the primary light assembly and/or the D-ring assembly or any combination thereof and all are considered within the scope of the invention. Other accessories can also be selected and used. Though the accessory components can be mixed, such as, but not limited to, a primary light on one side and the weight pocket on the other, etc., preferably each side only holds one accessory at a time.

With cinch plate 50 and accessories attached, installing webbing 550 occurs in much the same way as with conventional backplates 500 without a cinch plate 50 attached and is best seen in FIG. 4. The preferred continuous webbing 550 is weaved into the top backplate slots 512*a*, 512*b*, 514*a* and 514*b* and a grommet is centered at the top hole of the backplate. The chest d-rings, deflator hose retainer, elastic light holders, etc. can be installed at this time. With the appropriate accessories attached to cinch plate 50, as will be described below, the remaining continuous webbing 550 can be weaved into lower slots 502 and 504 (on each side of backplate 500) and slots 52*a*, 52*b*, 54*a* and 54*b* of cinch plate 50 and through loop/passageways associated with the desired accessories. A knife sheath on the waist strap or other devices can also be secured and lastly the waist buckle is secured to webbing 550.

Cinch adaptor plate 50 can also be provided with two relatively small rod pedestals 57 that keep the attached scuba tanks, re-breathers device or backpack device from coming directly in contact with webbing 550 as it rolls around through the dual slots of cinch plate 50, thus, given adequate space for the webbing 550 to roll around behind cinch plate 50 during adjustment. Other cutouts or holes, such as, but not limited to cutouts 55 and hole 67 can be provided in body member 51 for providing clearance or access to portion of backplate, etc.

Adjusting the harness in connection with cinch adaptor 50 can be relatively quick and easy. The harness can be adjusted in or out of the water and can be used for easy in-water tear removal. Preferably, to tighten the harness, the diver uses both hands while grasping the ends of the waist band portion of webbing 550 and pulls up and out at roughly 45 degrees from the body. If desired, an optional triglide can be placed on webbing 550 as a "stopper" to allow a full stop when the harness reaches a desired fit. To loosen the harness, the user can grasp the shoulder straps portion of webbing 550 just above the waist, and then push the harness out and away from his or her waist.

Though not considered limiting, there are preferably three major components or accessories that are used with cinch adaptor plate 50, which can also be used with the embodiments described for FIGS. 1-3. The three major components or accessories are the light canister or other accessory holder assembly 200 which is secured to one end of cinch adaptor plate 50, the ID-ring assembly 100 and a weight pocket. Both the light or accessory holder assembly 200 and the D-ring assembly 100 (as well as the weight pocket) contain passageways (similar to a belt loop) for allowing webbing 550 to flow through while the assemblies are affixed to corresponding ends of cinch adaptor plate 50. The passageway is best shown in FIG. 13 in connection with D-ring assembly 100 which shows webbing 550 passageway 130.

The assemblies can be preferably attached to the ends of cinch adaptor plate 50 by two different means. The assemblies can be mechanically fastened with a bolt or nut and washer type arrangement (such as but not limited to bolt 63*b* in FIG. 4) or a small strap or webbing portion 112 of the assemblies can be threaded through an additional third slot 56*a* and/or 55*h* on each side of the adaptor plate (preferably fastened with a conventional tri-glide 114). To form the passageways 130, preferably another piece of webbing 116 is sewn or otherwise secured perpendicularly to webbing 112 secured to cinch adaptor 50. Webbing 116 defines passageway 130 therethrough. Main harness webbing 550 is passed through the passageway 130 and more or less floats in place and still stays rigidly attached to the wearer while the harness is fastened at the waist buckle flatness webbing 550 (i.e. the shoulder and the waist component webbing) is completely free to move and slide through webbing 116 of the accessory attachment for D-ring 118 or the similar passageway webbing associated with weight pocket or the light canister or other accessory.

D-ring assembly 100 is shown in FIGS. 11 and 13, as well as in FIGS. 4 and 14, As mentioned above, D-ring assembly 110 attaches to one end or side of cinch plate 50 and can be fully adjustable, allowing the diver to select an optimal position for D-ring 118. The loop or passageway 130 created by webbing 116 of D-ring assembly 100 allows the waist strap portion of continuous harness webbing 550 to move freely without affecting or changing D-ring 118*s* (or the accessory attached to D-ring 118) position in relation to the diver, D-ring assembly 100 allows quick adjustment of the harness without affecting the hip d-ring 118 or attached accessory(ies). To secure D-ring assembly 100 to the end of cinch plate 50, webbing or strap 112 of D-ring assembly 100 is preferably threaded around cinch outer slot 56*a* and/or 56*b* and through a tri glide 114 on webbing or strap 112. Thus, the location of D-ring 118 can easily be adjusted along the diver's waist. D-ring 118 itself is preferably secured as part of assembly 100 by attached one end of webbing 112 to webbing 116 and threading webbing 112 through one slot 115 of a triglide 113, through D-ring 118 and then through a second slot 117 of tri-glide 113.

Webbing 112 can be threaded on the inside or outside of d-ring assembly 100. Threading on the outside allows easy adjustment but leaves an exposed tab of webbing. Threading inside is slightly cleaner but also a bit slower to adjust. Once D-ring assembly 100 is secured to cinch adaptor plate 50, the waist portion of webbing 550 can be threaded through the slots 502 and 504 on each side of backplate 500 (as well as through slots 52*a*, 52*b*, 54*a* and 54 of cinch adaptor 50) just as they would be threaded without the cinch plate in place (i.e. secured to backplate 500). After passing through the appropriate slots of backplate and the slots of cinch plate 50, harness webbing 550 threads through the belt-like loop or passageway 130 associated with D-ring assembly 100 (See FIG. 4). Then the waist strap buckle can be placed on the left side waist strap, though such is not considered limiting. In order to remove D-ring assembly 100, the process is reversed by first removing the waist strap buckle and unweaving D-ring assembly 100 from cinch plate 50. At this point a different accessory can be installed such as, but not limited to, a weight pocket, etc.

As seen in FIGS. 12*a* and 12*b*, as well as FIGS. 4 and 15, a light holder assembly 200 is shown and can consist of two pieces which enables easy adjustability of the diver's harness while wearing a hip mounted primary light. Webbing 210 can be a 2" reinforced piece of webbing though such is not considered limiting. Webbing 210 can be provided with a grommet 214 on one end 212 which is used for attaching webbing 210 to cinch plate adaptor 50 for supporting a hip mounted canister 600 or other object. Other dimensions for the reinforced piece of webbing can be used and are considered within the scope of the invention. Reinforced webbing 210 provides a relatively rigid surface to hold the light off the diver's hip, increasing comfort, while still enabling harness adjustability by a passageway 252 defined by webbing 250, similar to webbing 116 and passageway 130 of D-ring assembly 100. Light 600 includes its own attachment webbing 270 defining a passageway 272 for insertion therethrough of webbing 210 (See FIG. 15). Light 600 and associated holder 270 is substantially maintained in position on webbing 210 by buckle 230 that is secured to second webbing 250. End 216 of webbing 210 is sufficiently threaded through buckle 230 such that buckle 230 is adjacent or approximate to light 600 and the buckle is closed to maintain its position on webbing 210. Buckle 230 acts as a stop member for light holder 270, which prevents light holder from significantly moving along strap 210. The waist harness portion of continuous webbing 550 slides freely within passageway 252 of webbing 250 secured to buckle 230, thus, allowing a diver to loosen or tighten the harness without affecting the position of light 600, Buckle 230 allows the diver to easily adjust the position of light 600 along, webbing 210 or to remove light 600 while the harness remains secure. Light 600 can be adjusted or removed while the diver or user is in or out of the water.

Using a hip mounted canister 600 with light holder assembly 200 allows easy adjustment of webbing 550 while leaving light 600 unaffected. As seen in FIG. 4, to install light holder assembly 200, end 212 having grommet 214 can be inserted into the one of the outer slots 56*a* or 56*b* of cinch plate 56 (preferably right side slot 56*b*, but not considered limiting) and webbing 210 is folded so that a bolt (such as bolt 63*b*) can secure the light holder assembly 200 to cinch plate 50. Preferably, the same bolt 63*b* secures light assembly 200 to cinch plate 50 and cinch plate 50 to backplate 500.

As mentioned above, the attachment hardware can be provided with pre-applied loctite to ensure the connections remain secure. These bolts can tolerate several removal and replacement sessions before the loctite becomes ineffective. Once end 212 of webbing 210 is in place (secured to cinch 50) continuous harness webbing 550 can be threaded through backplate 500 and the tab (end 216) tinned through buckle assembly 230. To remove light holder assembly 200, bolt 63*b* which secures cinch plate 50 and light holder assembly 200 is first removed.

As mentioned above, cinch assembly 50 can also be used with weight pockets (not shown), in addition to the above described D-ring and light assemblies 100 and 200, respectively, and can attach to cinch plate 50 similar to how D-ring assembly 100 attaches to cinch plate 50 or how Hot holder assembly 200 attaches to D-ring assembly. Preferably, a weight pocket can be attached by securing the webbing tab to the appropriate side of the cinch accessory slot 56*a* or 56*b*. The webbing can be threaded on the inside or outside of the webbing assembly or secured with a grommet/webbing. Once the webbing tab is secured, the weight pocket can be threaded in place. The weight pockets can be adjusted toward or away from backplate 500 as desired. Any excess webbing can be fed into the weight pocket belt loop. The harness webbing threads through the backplate slots and the weight pocket belt loop passageway, which functions similar to passageways 130 and 252.

The above described features and benefits of the adapter assembly can be built directly into a new complete backplate assembly so that the same benefits of adjustability and fix positioning for the light canister, weight pockets, fix positioning for the D-ring for bottles and other accessory devices can still be applied to a complete back plate assembly. Preferably, the new backplate would be built or designed with the accessory slot on each side of the backplate, and thus the backplate would not necessarily have to extend beyond the backplate as accessory slots 56*a* and 56*b* currently do. The angled slots for the new backplate can also be constructed such that they are different in length. Furthermore, the new backplate can be designed, molded, formed, built, etc. such that it has a raised or humped smooth portion between the angled slots to function similarly to roller 530 or riser 60*a*, 60*b*.

The present invention single side cinch of full cinch adaptor or upgrade plate are preferably used for improving webbing adjustability of the thousands of backplates 500 that are already out in the field. Newly built backplates incorporating the features and functions of the present invention can be provided with the third additional slot within the standard perimeter of the backplate and thus wouldn't need that additional overhang or overhang that is provided with adapter plate 50 to accommodate the cinch accessory slots 56*a* and 56*b*.

As best seen in FIGS. 16 and 17, the present invention also provides for an improved adjustable crotch strap 300 having a crotch strap 302, which looks more professionally finished and is provided with a wide range of length adjustments. The invention permits crotch strap 302 to lock more permanently when it is in a "use" position. Current tri-glide technology is insufficient and is known to slip on occasion, especially when using a scooter device attached to the front D-ring of the crotch strap. The present invention provides for an improved tri-glide 340 system (shown best in FIG. 18) which is very robust and can be constructed from stainless steel and sized for receipt of 2 inch wide (though not considered limiting) and a certain thickness of webbing that is used with crotch straps. One benefit with improved crotch strap assembly 300 is that it allows for a second D-ring (not shown but preferably disposed at point "A" and associated with conventional tri-glide 323) to be added to the back of crotch strap 302 in the same fashion that the other backplate attachment points are added in a pass-through fashion.

When a diver uses a second scooter, he or she normally tows it behind the diver, which can now be towed with the present invention by the second D-ring on the crotch strap. Currently it is difficult to add a second D ring, even with the new improved tri-glide 340 of the present invention because it would almost certainly cause the large medal tri-glide to end up centered directly between the diver's legs, causing it to be extremely uncomfortable for the diver to try to close his or her legs together. With the present invention crotch strap assembly, tri-glide 340 preferably stays backed up behind the diver's hips rather than in between the diver's legs. If a second D-ring is added for towing a scooter or attaching other diving accessories to the second D-ring can be secured similar to the side-waist accessories are added with their pass-through effect as discussed above. Accordingly, the crotch strap itself passes through the passageway/slot of the second D-ring assembly and has its own independent attachment point, which can be an additional slot in the accessory device, cinch plate 50 or preferably a slot 517 in the backplate 500. Additionally, it can also be fasten via a bolt and washer type connection.

The quick adjust crotch strap 302 can be webbed with an adjustable buckle or tri-glide 340 that allows rapid resizing while eliminating any dangling webbing, and will hold securely while being used with a IRV. When installing the crotch strap assembly 30 the end of webbing 302 should run through the quick adjust buckle/tri-glide 340 with the curve facing up. Webbing 302 can be threaded through the backplate through slot 517 from the front to the back of backplate 500. Webbing 302 can be threaded through the novel quick adjust tri-glide 340 (FIG. 18), then back through both slots of the standard tri-glide 323. The length can be adjusted as needed to insure a proper fit. Preferably, the location of novel triglide 340 is roughly a hand width from the bottom of back plate 500, though such location is not considered limiting and other locations can be selected and are considered within the scope of the invention. Adjusting triglide 340 dose to back plate 500 allows for wider adjustment options.

Though the crotch strap length is sized correctly, the quick adjust triglide 340 may still sit incorrectly, e.g. too far forward and between the diver's legs. To correct this, the quick adjust triglide 340 is left in place and webbing 302 can be removed from triglide 323 and second D-ring. The webbing is then pulled through until the quick adjust triglide 340 is at an appropriate distance from back plate 500. With triglide 323 and the quick adjust triglide 340 fairly close together webbing 302 can then be threaded back through triglide 323 and second D-ring. The excess webbing "tail" 347 can be cut off, while leaving enough for future length adjustments.

Once the adjustable crotch strap assembly 300 is sized correctly, modifications can be done quickly by sliding webbing 302 through the quick adjust buckle/triglide 340. Excess webbing 302 may also be tucked air/nigh back plate 500 and secured with a section of the EPDM band 349 on crotch strap 302.

It is also important to note that the pass-through accessory attachment devices discussed above can also be used at the shoulder position of back plate webbing harness 550. It Call also be applied to the crotch strap to add additional D rings or other tensioning type accessories and it could also be applied to other positions around the harness. All uses are considered within the scope of the invention.

The present invention also discloses an ergonomic self-adjusting backplate system 400. Current backplates all act to be extremely stable and very good at weight balancing. However, due to the manufacturing process they are limited to single dimensional bins and forming. Therefore, current manufacturing processes and techniques do not permit for a compound curve that would actually match the curves and shapes of the human body, namely, the lumbar, the shoulder, etc.

The present invention ergonomic system 400, includes modern manufacturing processes, which permits the design shape of the rigid plate to use compound curves and floating adjustment type systems to help apply the weight of the scuba gear, rebreather systems or backpack mounting devices across the wearer's body more efficiently. The shoulder area includes compound curves 410 that tend to grip the upper and outer shoulder blade area, similar to a slightly tensioned hand, grabbing the top of the back of the shoulder and therefore transferring some of the load that was originally applied solely to the webbing strap coming across the shoulder. The present invention permits much of that weight to be managed by the compound curve structure at the top of the ergonomic backplate frame system 400. Down at the waist at the lumbar area of the back the present invention ergonomic system provides a pivotable compound curve fixture that rotates on an access about the central vertical frame 405. Certain bottom and top attachment parts that can be secured to vertical frame 405 are shown in FIG. 24. This pivoting loading type point can be adjustable vertically along frame 405 in view of the securement holes 407 and can be likely be compliant in its material makeup so that it forms to the body even though it already has a pre-stressed and a pre-shaped compound design to it. The flow through features of the quick adjust single piece webbing backplate, discussed above, can be applied to the present invention ergonomic frame system 400 and thus will enhance the adjustable vertical features of this new ergonomic plates. As seen in FIG. 23, cinch adaptor 50 can also be designed such that it can be secured to vertical frame 405.

Ergonomic frame system 400 provides for multiple vertical positions to size between different torso heights and can also have a roller type system 413 close to the central vertical frame, Roller-type devices 413 act as the interface between the shoulder portion and the waist portion of webbing 550 can also be vertically adjustable up and down the spine of frame 405 as well. The spine or vertical frame can also be curved and contoured to mimic a side profile of a human spine so that the pressure points and areas where the weight energy comes in contact with the body are less abrupt and more widely dispersed, therefore, making them less noticeable to the wearer.

The weight on the present invention ergonomic plate can call for the omission of the current ballast that is naturally found in a 6-10 pound rigid back plate. The frame will be a much more minimal structure in terms of mass, therefore, unique weight application methods can be applied. These weight application methods can be adjustable vertically and horizontally. They can accept the common lead systems that are currently available, such as, but not limited to, soft weights in low fabric pouches or conventional, hard lead which is found in a block shape from 2, 3, 4, 5 or 6 pounds. The weight receiver component for the ergonomic plate can accept a whole range of typical lead on the market and can be purely adjustable so that the diver can zero end on his diving attitude while in the water applying weights and other devices. The diver can have his or her plate and system setup in perfect harmony by a wide range of vertical adjustment options with the weight attachment pockets and/or molded-in features. The molded receivers can be potentially located anywhere along vertical spine 405 of frame system 400 and can also be attached at the lumbar or the shoulder positions of this present invention modular ergonomic frame system 400. A wide variety of different shapes and features can be provided for the compound shoulder attachment. The shoulder attachment can be permitted to swivel and can come in different varieties of shapes to fit a wide range of different body types and different applications.

The present invention supports the convenience of rapid adjustment and enhanced comfort. The present invention redefines what it means to dive a backplate, building upon a platform of simplicity while providing unprecedented security and ease of adjustment. With the present invention one can enjoy all the performance advantages of a backplate while easily changing suits or divers. The invention accomplishes these goals without compromising the harness with quick release buckles and while avoiding the dangling pieces of webbing common to other forms of rapid adjustment.

Adjustments are accomplished by simply sliding the harness through the unique, cinch adaptor assembly. Thus, divers can easily adjust the fit of their backplate in or out of the water, simply by pushing or pulling on the webbing and enjoying an unprecedented level of adjustability. As discussed above, these adjustments have no affect on a hip mounted weight pocket, d-ring or light canister. Thus, the diver can enjoy the snug, stable fit of a harness without worrying that a tight fit will be difficult to remove while in the water or on the dive boat. The cinch allows the diver to quickly remove his or her dive system and adjust to changes in undergarments or diving suits. Meanwhile the enhanced security of a snug fitting harness farther increases stability while eliminating the difficulty of getting into or out of the diving harness. As also discussed above, a quick adjust crotch strap is also secured to the cinch adaptor to ensure that any changes to the system can be done quickly and easily.

All time periods, measurements, amounts, weights, dimensions, values, percentages, materials orientations, etc. discussed above or shown in the drawing figures are merely by way of example and are not considered limiting and other time periods, measurements, amounts, weights, dimensions, values, percentages, materials, orientations etc. can be chosen and used and all are considered within the scope of the invention.

Dimensions of certain parts as shown in the drawings may have been modified and/or exaggerated for the purpose of clarity of illustration and are not considered limiting.

Unless feature(s), part(s), component(s), characteristic(s) or function(s) described in the specification or shown in the drawings for a claim element, claim step or claim term specifically appear in the claim with the claim element, claim step or claim term, then the inventor does not considered such feature(s), part(s), component(s), characteristic(s) or function(s) to be included for the claim element, claim step or claim term in the claim for examination purposes and when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or pans describe in the specification that are related to the function of the "means for" language.

While the invention has been described and disclosed in certain terms and has disclosed certain embodiments or modifications, persons skilled in the art who have acquainted themselves with the invention, will appreciate that it is not necessarily limited by such terms, nor to the Specific embodiments and modification disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. A combination backplate and device for improving an adjustability of a diver's harness waist webbing associated with the backplate, comprising:

a backplate having a pair of angled slots on at least one side of the backplate, wherein both slots from the pair of angled slots are located on a same side of the backplate:

a body member having a first slot and a second slot, said body member secured to the backplate adjacent to the pair of angles slots located at one side of the backplate such that the first slot of the body member is aligned with a first slot of the pair of angled slots of the backplate and the second slot of the body member is aligned with a second slot of the pair of angled slots of the backplate all on the same side of the backplate, an outer opening near the first slot of the body member and an outer opening near the second slot of the body member disposed far enough from said backplate such that the diver's harness waist webbing received through the first slot of the pair of angled slots of said backplate is sufficiently raised before being received through the second slot of the pair of angled slots of said backplate in order to greatly reduce friction between the waist webbing and the pair of angled slots of the backplate;

wherein the diver's waist harness webbing is intended to be disposed around a diver's waist and is a different and separate webbing from any webbing used to secure a SCUBA tank to the backplate.

2. The combination backplate and device for improving the adjustability of the diver's harness waist webbing of claim 1 wherein said body member further comprising an outwardly raised smooth member disposed on the same side of the backplate between the first and second slots that contacts the diver's harness waist webbing to further raise the diver's harness waist webbing.

3. The combination backplate and device for improving the adjustability of the diver's harness waist webbing of claim 1 wherein said body member constructed from a rigid plastic material.

4. The combination backplate and device for improving the adjustability of the diver's harness waist webbing of claim 1 wherein said pair of angled slots located at or near a bottom left or right side area of the backplate.

5. A combination backplate and device for improving an adjustability of a diver's harness waist webbing associated with the backplate, comprising:

a backplate having a first pair of backplate slots on a left side of the backplate and a second pair of backplate slots on a rights side of the backplate;

a first body member having a first slot and a second slot, said first body member secured to the backplate adjacent to the first pair of backplate slots located at the left side of the backplate to position and align the first slot of the first body member with a first slot of the first pair of backplate slots and position and align the second slot of the first body member with a second slot of the first pair of backplate slots such that the diver's harness waist webbing is received through the first slot of the first pair of backplate slots and the first slot of the first body member and then folded over a center portion of the first body member and then received through the second slot of the first body member and the second slot of the first pair of backplate slots in order to reduce friction between the waist webbing and the first pair of backplate slots of the backplate; and a second body member having a first slot and a second slot, said second body member secured to the backplate adjacent to the second pair of backplate slots located at the right side of the backplate to position and align the first slot of the second body member with a first slot of the second pair of backplate slots and position and align the second slot of the second body member with a second slot of the second pair of backplate slots such that the diver's harness waist webbing is received through the first slot of the second pair of backplate slots and the first slot of the second body member and then folded over a center portion of the second body member and then received through the second slot of the second body member and the second slot of the second pair of backplate slots in order to reduce friction between the waist webbing and the second pair of backplate slots of the backplate;

wherein the first body member having a height which sufficiently raises the diver's harness waist webbing before the diver's harness waist webbing is received through the second slot of the first pair of backplate slots and the second body member having a height which sufficiently raises the diver's harness waist webbing before the diver's harness waist webbing is received through the second slot of the second pair of backplate slots.

6. The combination backplate and device for improving the adjustability of the diver's harness waist webbing of claim 5 wherein in use the diver's harness waist webbing is adapted for disposal around a diver's waist and is a different and separate webbing from any webbing used to secure a SCUBA tank to the backplate.

7. The combination backplate and device for improving the adjustability of the diver's harness waist webbing of claim 5 wherein said first body member constructed from a rigid material and said second body member constructed from a rigid material.

8. The combination backplate and device for improving the adjustability of the diver's harness waist webbing of claim 5 wherein the first body member further comprising a first raised member disposed between the first and second slots of the first body member that contacts the diver's harness waist webbing to further raise the diver's harness waist webbing and the second body member further comprising a second raised member disposed between the first and second slots of the second body member that contacts the diver's harness waist webbing to further raised the diver's harness waist webbing.

9. The combination backplate and device for improving the adjustability of the diver's harness waist webbing of claim 8 wherein the first raised member having a circular cross-sectional body shape and the second raised member having a circular cross-sectional body shape.

10. A device for improving an adjustability of a diver's harness waist webbing associated with a backplate, the backplate has a pair of backplate slots on at least a left side or a right side of the backplate, said device comprising:

a body member having a first slot and a second slot, the body member adapted for securement to a diver's backplate adjacent to the pair of backplate slots located at one side of the backplate to position and align the first slot of the body member with a first slot of the pair of backplate slots and position and align the second slot of the body member with a second slot of the pair of backplate slots such that the diver's harness waist webbing is received through the first slot of the pair of backplate slots and the first slot of the body member and then folded over a center portion of the body member and then received through the second slot of the body member and the second slot of the pair of backplate slots in order to greatly reduce friction between the waist webbing and the pair of backplate slots of the backplate;

wherein said body member further comprising a raised member disposed between the first and second slots of the body member that contacts the diver's harness waist webbing to further raise the diver's harness waist webbing, wherein the raised member having a rounded or curved upper surface, the raised member having an upper portion having an arc cross-sectional shape.

11. The device for improving the adjustability of the diver's harness waist webbing of claim 10 wherein said raised member having a circular cross-sectional shape body member.

12. A combination backplate and device for improving an adjustability of a diver's harness waist webbing associated with the backplate, comprising:

a backplate having a first pair of angled slots on a left side of the backplate and a second pair of angled slots on a right side of the backplate, the first pair of angled slots located on a same surface plane of the backplate and the second pair of angled slots located on the same surface plane of the backplate, wherein the first pair of angled slots are angled at a non-parallel and non-perpendicular angle with respect to a first and second side edges, a top edge and a bottom edge of the backplate and the second pair of angled slots are angled at a non-parallel and non-perpendicular angle with respect to the first and second side edges, the top edge and the bottom edge of the backplate;

a first raised smooth protrusion disposed on the left side of the backplate within a first space defined between a first angled slot and a second angled slot of the first pair of angled slots and consuming at least a majority portion of the first space, the first protrusion permanently secured to or monolithically formed with the backplate between the first angled slot and the second angled slot of the first pair of angled slots, the first protrusion extending outward from the backplate such that the diver's harness waist webbing received through the first angled slot of the first pair of angled slots of said backplate is sufficiently raised before being received through the second angled slot of the first pair of angled slots of said backplate in order to reduce friction between the waist webbing and the first pair of angled slots of the backplate; and a second raised smooth protrusion disposed on the right side of the backplate within a second space defined between a first angled slot and a second angled slot of the second pair of angled slots and consuming at least a majority portion of the second space, the second protrusion permanently secured to or monolithically formed with the backplate between the first angled slot and the second angled slot of the second pair of angled slots, the second protrusion extending outward from the backplate such that the diver's harness waist webbing received through the first angled slot of the second pair of angled slots of said backplate is sufficiently raised before being received through the second angled slot of the second pair of angled slots of said backplate in order to reduce friction between the waist webbing and the second pair of angled slots of the backplate;

wherein the diver's harness waist webbing is intended to be disposed around a diver's waist and is a different and separate webbing from any webbing used to secure a SCUBA tank to the backplate.

13. The combination backplate and device for improving the adjustability of the diver's harness waist webbing of claim 12 wherein the first protrusion having a curved outer top area and the second protrusion having a curved top area.

14. The combination backplate and device for improving the adjustability of the diver's harness waist webbing of claim 12 wherein the first protrusion having an outer top area with a rounded first side and a rounded second side and the second protrusion having an outer top area with a rounded first side and a rounded second side.

15. The combination backplate and device for improving the adjustability of the diver's harness waist webbing of claim 12 wherein the first protrusion, the second protrusion and the backplate are monolithically formed as a one-piece member.

16. The combination backplate and device for improving the adjustability of the a diver's harness waist webbing of claim 12 wherein the first protrusion creates a smooth hump portion between the first angled slot and the second angled slot of the first pair of angled slots and the second protrusion creates a smooth hump portion between the first angled slot and the second angled slot of the second pair of angled slots.

* * * * *